US010887691B2

(12) United States Patent
Janse et al.

(10) Patent No.: US 10,887,691 B2
(45) **Date of Patent: *Jan. 5, 2021**

(54) AUDIO CAPTURE USING BEAMFORMING

(71) Applicant: KONINKLIJKE PHILIPS N.V., Eindhoven (NL)

(72) Inventors: Cornelis Pieter Janse, Eindhoven (NL); Patrick Kechichian, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/474,119

(22) PCT Filed: Dec. 28, 2017

(86) PCT No.: PCT/EP2017/084753

§ 371 (c)(1),
(2) Date: Jun. 27, 2019

(87) PCT Pub. No.: WO2018/127450

PCT Pub. Date: Jul. 12, 2018

(65) Prior Publication Data

US 2019/0342660 A1 Nov. 7, 2019

(30) Foreign Application Priority Data

Jan. 3, 2017 (EP) ..... 17150115

(51) Int. Cl.
*H04R 3/00* (2006.01)
*G10L 21/0232* (2013.01)
(Continued)

(52) U.S. Cl.
CPC ..... *H04R 3/005* (2013.01); *G10L 21/0232* (2013.01); *H04R 1/406* (2013.01); *G10L 25/78* (2013.01); *G10L 2021/02166* (2013.01)

(58) Field of Classification Search
CPC ..... H04R 3/005; H04R 1/406; H04R 1/326; H04R 29/005; G10L 15/20;
(Continued)

(56) References Cited

U.S. PATENT DOCUMENTS 7,146,012 B1 12/2006 Belt et al.
7,602,926 B2 10/2009 Roovers
(Continued)

FOREIGN PATENT DOCUMENTS

WO 2007004188 A2 1/2007
WO 2015139938 A 9/2015

OTHER PUBLICATIONS

Boll "Suppression of Acoustic Noise in Speech Using Spectral Subtraction" IEEE Trans. Acoustics, Speech and Signal Processing, vol. 27, p. 113-120 Apr. 1979.
(Continued)

*Primary Examiner* — Jason R Kurr

(57) ABSTRACT

An audio capture apparatus comprises a microphone array (301) and a beamformer (303) arranged to generate a beamformed audio output signal and a noise reference signal. A first and second transformer (309, 311) generates a first and second frequency domain signal from a frequency transform of the beamformed audio output signal and noise reference signal respectively. A difference processor (313) generates time frequency tile difference measures which for a given frequency is indicative of a difference between a monotonic function of a norm (magnitude) of a time frequency tile value of the first frequency domain signal and a monotonic function of a norm of a time frequency tile value of the second frequency domain signal for the first frequency. An estimator (315) generates an estimate indicative of whether the audio output signal comprises a point audio source in response to a combined difference value for time frequency
(Continued)

tile difference measures for frequencies above a frequency threshold.

21 Claims, 9 Drawing Sheets

(51) Int. Cl.
*H04R 1/40* (2006.01)
*G10L 25/78* (2013.01)
*G10L 21/0216* (2013.01)

(58) Field of Classification Search
CPC . G10L 21/0208; G10L 21/0232; G10L 25/78; G10L 2021/02166
USPC ..... 381/92
See application file for complete search history.

(56) References Cited

U.S. PATENT DOCUMENTS

| | | | | |
|---|---|---|---|---|
| 10,026,415 | B2 | 7/2018 | Janse et al. | |
| 2008/0232607 | A1 | 9/2008 | Tashev et al. | |
| 2017/0337932 | A1* | 11/2017 | Iyengar | G10L 21/0208 |
| 2018/0033447 | A1* | 2/2018 | Ramprashad | G10L 21/0216 |

OTHER PUBLICATIONS

Search Report from PCT/EP2017/084753 dated Apr. 5, 2018.

* cited by examiner

AUDIO CAPTURE USING BEAMFORMING

CROSS-REFERENCE TO PRIOR APPLICATIONS

This application is the U.S. National Phase application under 35 U.S.C. § 371 of International Application No. PCT/EP2017/084753, filed on Dec. 28, 2017, which claims the benefit of EP Patent Application No. EP 17150115.8, filed on Jan. 3, 2017. These applications are hereby incorporated by reference herein.

FIELD OF THE INVENTION

The invention relates to audio capture using beamforming and in particular, but not exclusively, to speech capture using beamforming.

BACKGROUND OF THE INVENTION

Capturing audio, and in particularly speech, has become increasingly important in the last decades. Indeed, capturing speech has become increasingly important for a variety of applications including telecommunication, teleconferencing, gaming, audio user interfaces, etc. However, a problem in many scenarios and applications is that the desired speech source is typically not the only audio source in the environment. Rather, in typical audio environments there are many other audio/noise sources which are being captured by the microphone. One of the critical problems facing many speech capturing applications is that of how to best extract speech in a noisy environment. In order to address this problem a number of different approaches for noise suppression have been proposed.

Indeed, research in e.g. hands-free speech communications systems is a topic that has received much interest for decades. The first commercial systems available focused on professional (video) conferencing systems in environments with low background noise and low reverberation time. A particularly advantageous approach for identifying and extracting desired audio sources, such as e.g. a desired speaker, was found to be the use of beamforming based on signals from a microphone array. Initially, microphone arrays were often used with a focused fixed beam but later the use of adaptive beams became more popular.

In the late 1990's, hands-free systems for mobiles started to be introduced. These were intended to be used in many different environments, including reverberant rooms and at high(er) background noise levels. Such audio environments provide substantially more difficult challenges, and in particular may complicate or degrade the adaptation of the formed beam.

Initially, research in audio capture for such environments focused on echo cancellation, and later on noise suppression. An example of an audio capture system based on beamforming is illustrated in FIG. 1. In the example, an array of a plurality of microphones 101 are coupled to a beamformer 103 which generates an audio source signal z(n) and and one or more noise reference signal(s) x(n).

The microphone array 101 may in some embodiments comprise only two microphones but will typically comprise a higher number.

The beamformer 103 may specifically be an adaptive beamformer in which one beam can be directed towards the speech source using a suitable adaptation algorithm.

For example, U.S. Pat. Nos. 7,146,012 and 7,602,926 discloses examples of adaptive beamformers that focus on the speech but also provides a reference signal that contains (almost) no speech.

The beamformer creates an enhanced output signal, z(n), by adding the desired part of the microphone signals coherently by filtering the received signals in forward matching filters and adding the filtered outputs. Also, the output signal is filtered in backward adaptive filters having conjugate filter responses to the forward filters (in the frequency domain corresponding to time inversed impulse responses in the time domain). Error signals are generated as the difference between the input signals and the outputs of the backward adaptive filters, and the coefficients of the filters are adapted to minimize the error signals thereby resulting in the audio beam being steered towards the dominant signal. The generated error signals x(n) can be considered as noise reference signals which are particularly suitable for performing additional noise reduction on the enhanced output signal z(n).

The primary signal z(n) and the reference signal x(n) are typically both contaminated by noise. In case the noise in the two signals is coherent (for example when there is an interfering point noise source), an adaptive filter 105 can be used to reduce the coherent noise.

For this purpose, the noise reference signal x(n) is coupled to the input of the adaptive filter 105 with the output being subtracted from the audio source signal z(n) to generate a compensated signal r(n). The adaptive filter 105 is adapted to minimize the power of the compensated signal r(n), typically when the desired audio source is not active (e.g. when there is no speech) and this results in the suppression of coherent noise.

The compensated signal is fed to a post-processor 107 which performs noise reduction on the compensated signal r(n) based on the noise reference signal x(n). Specifically, the post-processor 107 transforms the compensated signal r(n) and the noise reference signal x(n) to the frequency domain using a short-time Fourier transform. It then, for each frequency bin, modifies the amplitude of R(w) by subtracting a scaled version of the amplitude spectrum of X(w). The resulting complex spectrum is transformed back to the time domain to yield the output signal q(n) in which noise has been suppressed. This technique of spectral subtraction was first described in S. F. Boll, "Suppression of Acoustic Noise in Speech using Spectral Subtraction," IEEE Trans. Acoustics, Speech and Signal Processing, vol. 27, pp. 113-120, April 1979.

A specific example of noise suppression based on relative energies of the audio source signal and the noise reference signal in individual time frequency tiles is described in WO2015139938A.

In many scenarios and applications, it is desirable to be able to detect the presence of a point audio source in a signal captured by a beamformer. For example, in a speech control system, it may be desirable to only try to detect speech commands during times when a speaker is actually being captured. As another example, it may be desirable to determine a noise estimate by measuring the captured signal during times when no speech is present.

Thus, a reliable point audio source detector for a beamformer would be highly desirable. Various point audio source detection algorithms have been proposed in the past but these tend to be developed for situations where the point audio source is close to the microphone array and where the signal to noise ratio is high. In particular, they tend to be directed towards scenarios in which the direct path (and possibly the early reflections) dominate both the later reflections, the reverberation tail, and indeed noise from other sources (including diffuse background noise).

As a consequence, such point audio source detection approaches tend to be suboptimal in environments where these assumptions are not met, and indeed tend to provide suboptimal performance for many real-life applications.

Indeed, audio capture in general, and in particular processes such as speech enhancement (beamforming, de-reverberation, noise suppression), for sources outside the reverberation radius is difficult to achieve satisfactorily due to the energy of the direct field from the source to the device being small in comparison to the energy of the reflected speech and the acoustic background noise.

In many audio capture systems, a plurality of beamformers which independently can adapt to audio sources may be applied. For example, in order to track two different speakers in an audio environment, an audio capturing apparatus may include two independently adaptive beamformers.

Indeed, although the system of FIG. 1 provides very efficient operation and advantageous performance in many scenarios, it is not optimum in all scenarios. Indeed, whereas many conventional systems, including the example of FIG. 1, provide very good performance when the desired audio source/speaker is within the reverberation radius of the microphone array, i.e. for applications where the direct energy of the desired audio source is (preferably significantly) stronger than the energy of the reflections of the desired audio source, it tends to provide less optimum results when this is not the case. In typical environments, it has been found that a speaker typically should be within 1-1.5 meter of the microphone array.

However, there is a strong desire for audio based hands-free solutions, applications, and systems where the user may be at further distances from the microphone array. This is for example desired both for many communication and for many voice control systems and applications. Systems providing speech enhancement including dereverberation and noise suppression for such situations are in the field referred to as super hands-free systems.

In more detail, when dealing with additional diffuse noise and a desired speaker outside the reverberation radius the following problems may occur:

The beamformer may often have problems distinguishing between echoes of the desired speech and diffuse background noise, resulting in speech distortion.

The adaptive beamformer may converge slower towards the desired speaker. During the time when the adaptive beam has not yet converged, there will be speech leakage in the reference signal, resulting in speech distortion in case this reference signal is used for non-stationary noise suppression and cancellation. The problem increases when there are more desired sources that talk after each other.

A solution to deal with slower converging adaptive filters (due to the background noise) is to supplement this with a number of fixed beams being aimed in different directions as illustrated in FIG. 2. However, this approach is particularly developed for scenarios wherein a desired audio source is present within the reverberation radius. It may be less efficient for audio sources outside the reverberation radius and may often lead to non-robust solutions in such cases, especially if there is also acoustic diffuse background noise.

The use of multiple interworking beamformers to improve performance for non-dominant sources in noise and reverberant environments may improve performance in many scenarios and systems. However, in many systems, the interworking between beamformers involve detecting whether point audio sources are present in individual beams. As previously mentioned, this is a very challenging problem in many practical systems.

For example, typical prior art detections are based on power comparisons of the output signals of the respective beamformers. However, this approach typically fails for sources that are outside the reverberation radius and/or where the signal to noise ratio is too low.

Specifically, for multi-beamform systems, a proposed approach is to implement a controller that use estimates of the powers of the output signals of the respective beams to select one beam to use. Specifically, the beam with the largest output power is selected.

If the desired speaker is within the reverberation radius of the microphone array, then the differences in output power of different beams (aimed in different directions) will tend be large, and accordingly robust detectors can be implemented which also distinguish situations with active speakers from noise only situations. For example the maximum power can be compared to the averaged power of all beamformer outputs and speech can be considered to be detected if this difference is sufficiently high.

However, if the desired speaker is further away and especially outside the reverberation radius, problems start to arise.

For example, since the energies of the (later) reflections become dominant, the powers of all beamformer outputs will start to approach each other, and the ratio of the maximum power and averaged power approach unity. This will make detection based on such a parameter less reliable and indeed will render it impractical in many situations.

Also, since the desired speaker is further away from the array, the Signal-to-Noise Ratio (SNR) decreases and this will further exacerbate the problems described above. For diffuse noise, the expected value of the powers on the microphones will be equal. Instantaneously however, there will be differences. This makes the realization of a robust and fast speech estimator difficult.

Hence, an improved audio capture approach would be advantageous, and in particular an approach providing an improved point audio source detection/estimation would be advantageous. In particular, an approach allowing reduced complexity, increased flexibility, facilitated implementation, reduced cost, improved audio capture, improved suitability for capturing audio outside the reverberation radius, reduced noise sensitivity, improved speech capture, improved point audio source detection/estimation reliability, improved control, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio capture apparatus comprising: a microphone array; at least a first beamformer arranged to generate a beamformed audio output signal and at least one noise reference signal; a first transformer for generating a first frequency domain signal from a frequency transform of the beamformed audio output signal, the first frequency domain signal being represented by time frequency tile values; a second transformer for generating a second frequency domain signal from a frequency transform of the at least one noise reference signal, the second frequency domain signal being represented by time frequency tile values; a difference processor arranged to generate time frequency tile difference measures, a time frequency tile difference measure for a first frequency being indicative of a difference between a first monotonic function of a norm of a time frequency tile value of the first frequency domain signal for the first frequency and a second monotonic function of a norm of a time frequency tile value of the second frequency domain signal for the first frequency; a point audio source estimator for generating a point audio source estimate indicative of whether the beamformed audio output signal comprises a point audio source, the point audio source estimator being arranged to generate the point audio source estimate in response to a combined difference value for time frequency tile difference measures for frequencies above a frequency threshold.

The invention may in many scenarios and applications provide an improved point audio source estimation/detection. In particular, an improved estimate may often be provided in scenarios wherein the direct path from audio sources to which the beamformers adapt are not dominant. Improved performance for scenarios comprising a high degree of diffuse noise, reverberant signals and/or late reflections can often be achieved. Improved detection for point audio source at further distances, and particularly outside the reverberation radius, can often be achieved.

The audio capturing apparatus may in many embodiments comprise an output unit for generating an audio output signal in response to the beamformed audio output signal and the point audio source estimate. For example, the output unit may comprise a mute function that mutes the output when no point audio source is detected.

The beamformer may be an adaptive beamformer comprising adaptation functionality for adapting the adaptive impulse responses of the beamform filters (thereby adapting the effective directivity of the microphone array).

The beamformer may be a filter-and-combine beamformer. The filter-and-combine beamformer may comprise a beamform filter for each microphone and a combiner for combining the outputs of the beamform filters to generate the beamformed audio output signal. The filter-and-combine beamformer may specifically comprise beamform filters in the form of Finite Response Filters (FIRs) having a plurality of coefficients.

The first and second monotonic functions may typically both be monotonically increasing functions, but may in some embodiments both be monotonically decreasing functions.

The norms may typically be L1 or L2 norms, i.e. specifically the norms may correspond to a magnitude or power measure for the time frequency tile values.

A time frequency tile may specifically correspond to one bin of the frequency transform in one time segment/frame. Specifically, the first and second transformers may use block processing to transform consecutive segments of the first and second signal. A time frequency tile may correspond to a set of transform bins (typically one) in one segment/frame.

The at least one beamformer may comprise two beamformers where one generates the beamformed audio output signal and the other generates the noise reference signal. The two beamformers may be coupled to different, and potentially disjoint, sets of microphones of the microphone array. Indeed, in some embodiments, the microphone array may comprise two separate sub-arrays coupled to the different beamformers. The subarrays (and possibly the beamformers) may be at different positions, potentially remote from each other. Specifically, the subarrays (and possibly the beamformers) may be in different devices.

In some embodiments of the invention, only a subset of the plurality of microphones in an array may be coupled to a beamformer.

In accordance with an optional feature of the invention, the point audio source estimator is arranged to detect a presence of a point audio source in the beamformed audio output in response to the combined difference value exceeding a threshold.

The approach may typically provide an improved point audio source detection for beamformers, and especially for detecting point audio sources outside the reverberation radius, where the direct field is not dominant.

In accordance with an optional feature of the invention, the frequency threshold is not below 500 Hz.

This may further improve performance, and may e.g. in many embodiments and scenarios ensure that a sufficient or improved decorrelation is achieved between the beamformed audio output signal values and the noise reference signal values used in determining the point audio source estimate. In some embodiments, the frequency threshold is advantageously not below 1 kHz, 1.5 kHz, 2 kHz, 3 kHz or even 4 kHz.

In accordance with an optional feature of the invention, the difference processor is arranged to generate a noise coherence estimate indicative of a correlation between an amplitude of the beamformed audio output signal and an amplitude of the at least one noise reference signal; and at least one of the first monotonic function and the second monotonic function is dependent on the noise coherence estimate.

This may further improve performance, and may specifically in many embodiments in particular provide improved performance for microphone arrays with smaller inter-microphone distances.

The noise coherence estimate may specifically be an estimate of the correlation between the amplitudes of the beamformed audio output signal and the amplitudes of the noise reference signal when there is no point audio source active (e.g. during time periods with no speech, i.e. when the speech source is inactive). The noise coherence estimate may in some embodiments be determined based on the beamformed audio output signal and the noise reference signal, and/or the first and second frequency domain signals. In some embodiments, the noise coherence estimate may be generated based on a separate calibration or measurement process.

In accordance with an optional feature of the invention, the difference processor is arranged to scale the norm of the time frequency tile value of the first frequency domain signal for the first frequency relative to the norm of the time frequency tile value of the second frequency domain signal for the first frequency in response to the noise coherence estimate.

This may further improve performance, and may specifically in many embodiments provide an improved accuracy of the point audio source estimate. It may further allow a low complexity implementation.

In accordance with an optional feature of the invention, the difference processor is arranged to generate the time frequency tile difference measure for time $t_k$ at frequency $\omega_l$ substantially as:

$$d=|Z(t_k,\omega_l)|-\gamma C(t_k,\omega_l)|X(t_k,\omega_l)|$$

where $Z(t_k,\omega_l)$ is the time frequency tile value for the beamformed audio output signal at time $t_k$ at frequency $\omega_l$; $X(t_k,\omega_l)$ is the time frequency tile value for the at least one noise reference signal at time $t_k$ at frequency $\omega_l$; $C(t_k,\omega_l)$ is a noise coherence estimate at time $t_k$ at frequency $\omega_l$; and $\gamma$ is a design parameter.

This may provide a particularly advantageous point audio source estimate in many scenarios and embodiments.

In accordance with an optional feature of the invention, the difference processor is arranged to filter at least one of the time frequency tile values of the beamformed audio output signal and the time frequency tile values of the at least one noise reference signal.

This may provide an improved point audio source estimate. The filtering may be a low pass filtering, such as e.g. an averaging.

In accordance with an optional feature of the invention, the filter is both a frequency direction and a time direction.

This may provide an improved point audio source estimate. The difference processor may be arranged to filter time frequency tile values over a plurality of time frequency tiles, the filtering including time frequency tiles differing in both time and frequency.

In accordance with an optional feature of the invention, the audio capturing apparatus comprises a plurality of beamformers including the beamformer; and the point audio source estimator is arranged to generate a point audio source estimate for each beamformer of the plurality of beamformers; and the audio capturing apparatus further comprises an adapter for adapting at least one of the plurality of beamformers in response to the point audio source estimates.

This may further improve performance, and may specifically in many embodiments provide an improved adaptation performance for systems utilizing a plurality of beamformers. In particular, it may allow the overall performance of the system to provide both accurate and reliable adaptation to the current audio scenario while at the same time providing quick adaptation to changes in this (e.g. when a new audio source emerges).

In accordance with an optional feature of the invention, the plurality of beamformers comprises a first beamformer arranged to generate a beamformed audio output signal and at least one noise reference signal; and a plurality of constrained beamformers coupled to the microphone array and each arranged to generate a constrained beamformed audio output and at least one constrained noise reference signal; the audio capturing apparatus further comprising: a beam difference processor for determining a difference measure for at least one of the plurality of constrained beamformers, the difference measure being indicative of a difference between beams formed by the first beamformer and the at least one of the plurality of constrained beamformers; wherein the adapter is arranged to adapt constrained beamform parameters with a constraint that constrained beamform parameters are adapted only for constrained beamformers of the plurality of constrained beamformers for which a difference measure has been determined that meets a similarity criterion.

The invention may provide improved audio capture in many embodiments. In particular, improved performance in reverberant environments and/or for audio sources may often be achieved. The approach may in particular provide improved speech capture in many challenging audio environments. In many embodiments, the approach may provide reliable and accurate beam forming while at the same time providing fast adaptation to new desired audio sources. The approach may provide an audio capturing apparatus having reduced sensitivity to e.g. noise, reverberation, and reflections. In particular, improved capture of audio sources outside the reverberation radius can often be achieved.

In some embodiments, an output audio signal from the audio capturing apparatus may be generated in response to the first beamformed audio output and/or the constrained beamformed audio output. In some embodiments, the output audio signal may be generated as a combination of the constrained beamformed audio output, and specifically a selection combining selecting e.g. a single constrained beamformed audio output may be used.

The difference measure may reflect the difference between the formed beams of the first beamformer and of the constrained beamformer for which the difference measure is generated, e.g. measured as a difference between directions of the beams. In many embodiments, the difference measure may be indicative of a difference between the beamformed audio outputs from the first beamformer and the constrained beamformer. In some embodiments, the difference measure may be indicative of a difference between the beamform filters of the first beamformer and of the constrained beamformer. The difference measure may be a distance measure, such as e.g. a measure determined as the distance between vectors of the coefficients of the beamform filters of the first beamformer and the constrained beamformer.

It will be appreciated that a similarity measure may be equivalent to a difference measure in that a similarity measure by providing information relating to the similarity between two features inherently also provides information relating the difference between these, and vice versa.

The similarity criterion may for example comprise a requirement that the difference measure is indicative of a difference being below a given measure, e.g. it may be required that a difference measure having increasing values for increasing difference is below a threshold.

Adaptation of the beamformers may be by adapting filter parameters of the beamform filters of the beamformers, such as specifically by adapting filter coefficients. The adaptation may seek to optimize (maximize or minimize) a given adaptation parameter, such as e.g. maximizing an output signal level when an audio source is detected or minimizing it when only noise is detected. The adaptation may seek to modify the beamform filters to optimize a measured parameter.

In accordance with an optional feature of the invention, the adapter is arranged to adapt constrained beamform parameters only for constrained beamformers for which the point audio source estimate is indicative of a presence of a point audio source in the constrained beamformed audio output.

This may further improve performance, and may e.g. provide a more robust performance resulting in improved audio capture.

In accordance with an optional feature of the invention, the adapter is arranged to adapt constrained beamform parameters only for the constrained beamformer for which the point audio source estimate is indicative of highest probability that the beamformed audio output comprises a point audio source.

This may provide improved performance in many scenarios.

In accordance with an optional feature of the invention, the adapter is arranged to adapt constrained beamform parameters only for the constrained beamformer for which the point audio source estimate is indicative of highest probability that the beamformed audio output comprises a point audio source.

This may provide improved performance in many scenarios.

According to an aspect of the invention there is provided a method of operation for capturing audio using a microphone array, the method comprising: at least a first beamformer generating a beamformed audio output signal and at least one noise reference signal; a first transformer generating a first frequency domain signal from a frequency transform of the beamformed audio output signal, the first frequency domain signal being represented by time frequency tile values; a second transformer generating a second frequency domain signal from a frequency transform of the at least one noise reference signal, the second frequency domain signal being represented by time frequency tile values; a difference processor generating time frequency tile difference measures, a time frequency tile difference measure for a first frequency being indicative of a difference between a first monotonic function of a norm of a time frequency tile value of the first frequency domain signal for the first frequency and a second monotonic function of a norm of a time frequency tile value of the second frequency domain signal for the first frequency; a point audio source estimator generating a point audio source estimate indicative of whether the beamformed audio output signal comprises a point audio source, the point audio source estimator being arranged to generate the point audio source estimate in response to a combined difference value for time frequency tile difference measures for frequencies above a frequency threshold.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a speech capturing audio system based on beamforming but it will be appreciated that the approach is applicable to many other systems and scenarios for audio capturing.

Figure 3:
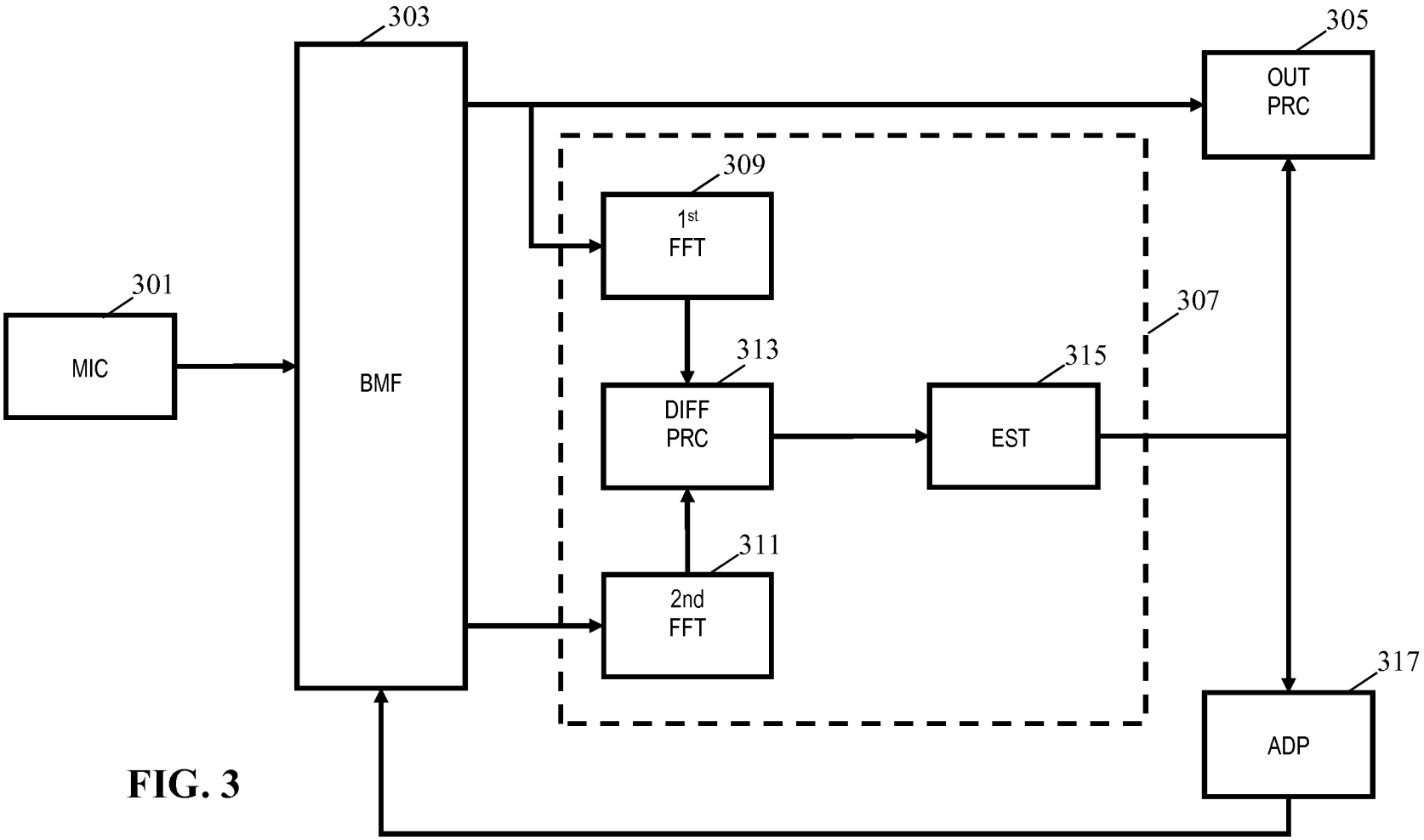
FIG. 3 illustrates an example of elements of an audio capturing apparatus in accordance with some embodiments of the invention.

FIG. 3 illustrates an example of some elements of an audio capturing apparatus in accordance with some embodiments of the invention.

The audio capturing apparatus comprises a microphone array 301 which comprises a plurality of microphones arranged to capture audio in the environment.

The microphone array 301 is coupled to a beamformer 303 (typically either directly or via an echo canceller, amplifiers, digital to analog converters etc. as will be well known to the person skilled in the art).

The beamformer 303 is arranged to combine the signals from the microphone array 301 such that an effective directional audio sensitivity of the microphone array 301 is generated. The beamformer 303 thus generates an output signal, referred to as the beamformed audio output or beamformed audio output signal, which corresponds to a selective capturing of audio in the environment. The beamformer 303 is an adaptive beamformer and the directivity can be controlled by setting parameters, referred to as beamform parameters, of the beamform operation of the beamformer 303, and specifically by setting filter parameters (typically coefficients) of beamform filters.

The beamformer 303 is accordingly an adaptive beamformer where the directivity can be controlled by adapting the parameters of the beamform operation.

The beamformer 303 is specifically a filter-and-combine (or specifically in most embodiments a filter-and-sum) beamformer. A beamform filter may be applied to each of the microphone signals and the filtered outputs may be combined, typically by simply being added together.

Figure 4:
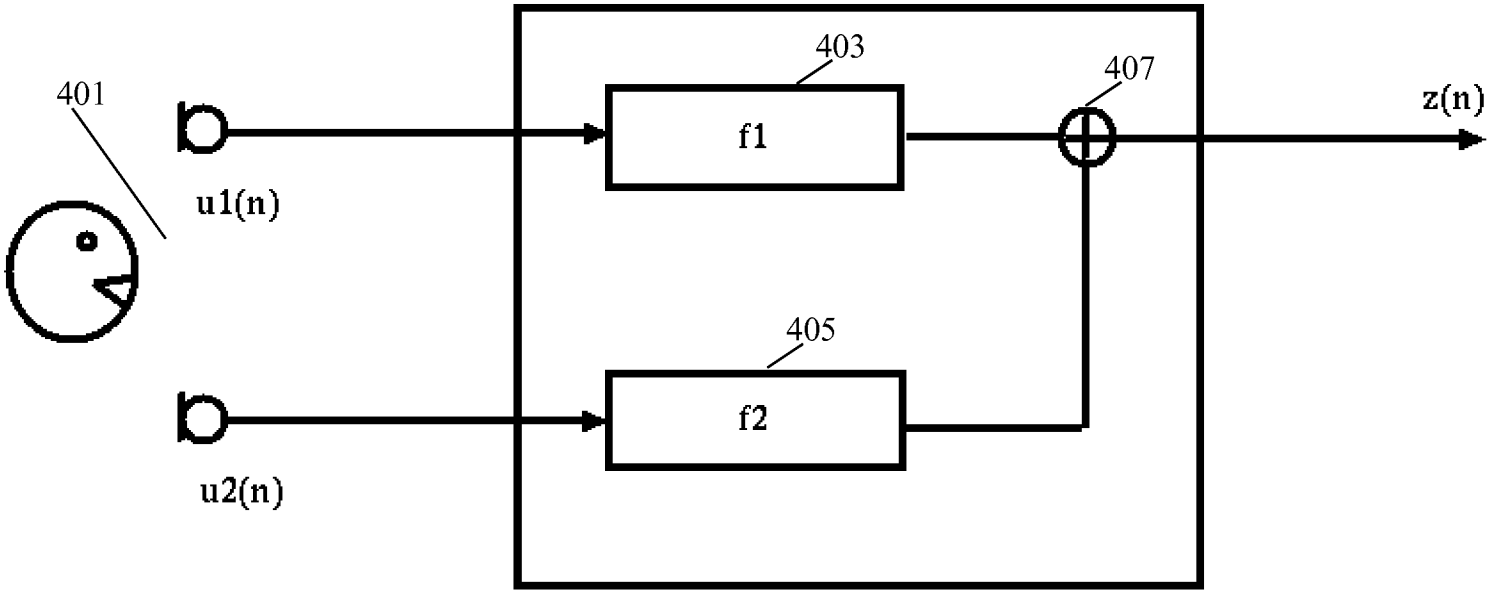
FIG. 4 illustrates an example of elements of a filter-and-sum beamformer.

FIG. 4 illustrates a simplified example of a filter-and-sum beamformer based on a microphone array comprising only two microphones 401. In the example, each microphone is coupled to a beamform filter 403, 405 the outputs of which are summed in summer 407 to generate a beamformed audio output signal. The beamform filters 403, 405 have impulse responses f1 and f2 which are adapted to form a beam in a given direction. It will be appreciated that typically the microphone array will comprise more than two microphones and that the principle of FIG. 4 is easily extended to more microphones by further including a beamform filter for each microphone.

The beamformer 303 may include such a filter-and-sum architecture for beamforming (as e.g. in the beamformers of U.S. Pat. Nos. 7,146,012 and 7,602,926). It will be appreciated that in many embodiments, the microphone array 301 may however comprise more than two microphones. Further, it will be appreciated that the beamformer 303 include functionality for adapting the beamform filters as previously described. Also, in the specific example, the beamformer 303 generates not only a beamformed audio output signal but also a noise reference signal.

In most embodiments, each of the beamform filters has a time domain impulse response which is not a simple Dirac pulse (corresponding to a simple delay and thus a gain and phase offset in the frequency domain) but rather has an impulse response which typically extends over a time interval of no less than 2, 5, 10 or even 30 msec.

The impulse response may often be implemented by the beamform filters being FIR (Finite Impulse Response) filters with a plurality of coefficients. The beamformer 303 may in such embodiments adapt the beamforming by adapting the filter coefficients. In many embodiments, the FIR filters may have coefficients corresponding to fixed time offsets (typically sample time offsets) with the adaptation being achieved by adapting the coefficient values. In other embodiments, the beamform filters may typically have substantially fewer coefficients (e.g. only two or three) but with the timing of these (also) being adaptable.

A particular advantage of the beamform filters having extended impulse responses rather than being a simple variable delay (or simple frequency domain gain/phase adjustment) is that it allows the beamformer 303 to not only adapt to the strongest, typically direct, signal component. Rather, it allows the beamformer 303 to adapt to include further signal paths corresponding typically to reflections. Accordingly, the approach allows for improved performance in most real environments, and specifically allows improved performance in reflecting and/or reverberating environments and/or for audio sources further from the microphone array 301.

It will be appreciated that different adaptation algorithms may be used in different embodiments and that various optimization parameters will be known to the skilled person. For example, the beamformer 303 may adapt the beamform parameters to maximize the output signal value of the beamformer 303. As a specific example, consider a beamformer where the received microphone signals are filtered with forward matching filters and where the filtered outputs are added. The output signal is filtered by backward adaptive filters, having conjugate filter responses to the forward filters (in the frequency domain corresponding to time inversed impulse responses in the time domain. Error signals are generated as the difference between the input signals and the outputs of the backward adaptive filters, and the coefficients of the filters are adapted to minimize the error signals thereby resulting in the maximum output power. This can further inherently generate a noise reference signal from the error signal. Further details of such an approach can be found in U.S. Pat. Nos. 7,146,012 and 7,602,926.

It is noted that approaches such as that of U.S. Pat. Nos. 7,146,012 and 7,602,926 are based on the adaptation being based both on the audio source signal z(n) and the noise reference signal(s) x(n) from the beamformers, and it will be appreciated that the same approach may be used for the beamformer of FIG. 3.

Figure 1:
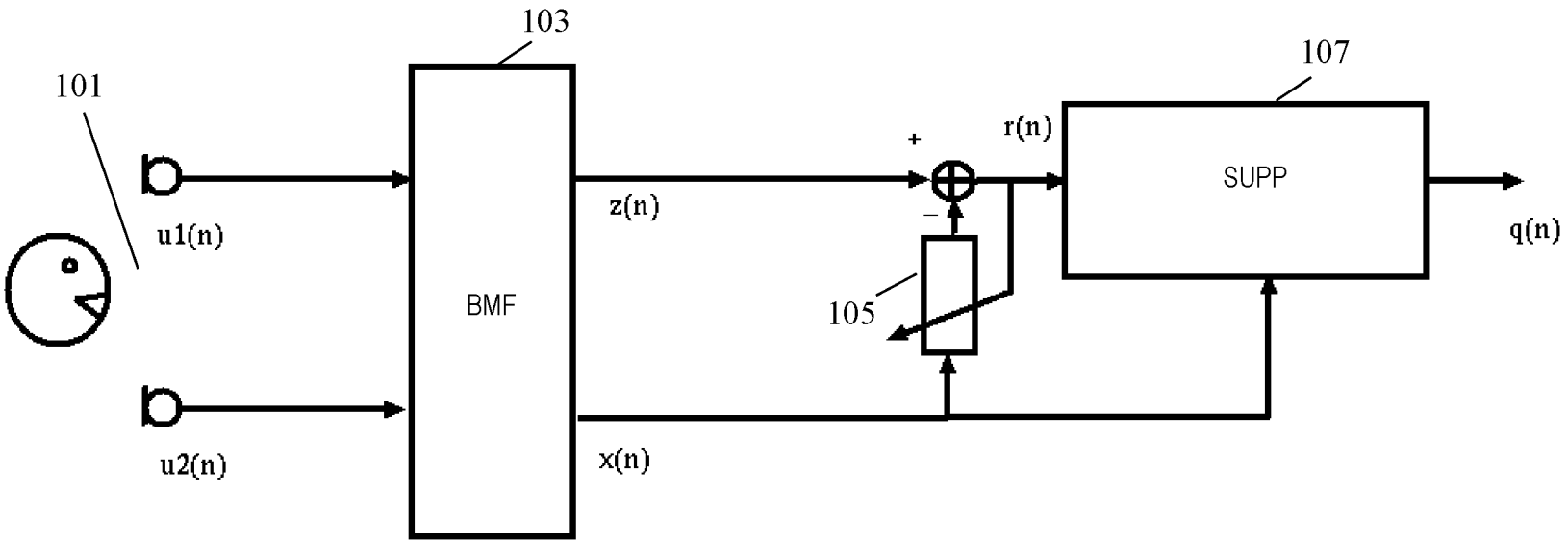
FIG. 1 PRIOR ART
FIG. 1 illustrates an example of elements of a beamforming audio capturing system.

Indeed, the beamformer 303 may specifically be a beamformer corresponding to the one illustrated in FIG. 1 and disclosed in U.S. Pat. Nos. 7,146,012 and 7,602,926.

The beamformer 303 is arranged to generate both a beamformed audio output signal and a noise reference signal.

The beamformer 303 may be arranged to adapt the beamforming to capture a desired audio source and represent this in the beamformed audio output signal. It may further generate the noise reference signal to provide an estimate of a remaining captured audio, i.e. it is indicative of the noise that would be captured in the absence of the desired audio source.

In the example where the beamformer 303 is a beamformer as disclosed in U.S. Pat. Nos. 7,146,012 and 7,602,926, the noise reference may be generated as previously described, e.g. by directly using the error signal. However, it will be appreciated that other approaches may be used in other embodiments. For example, in some embodiments, the noise reference may be generated as the microphone signal from an (e.g. omni-directional) microphone minus the generated beamformed audio output signal, or even the microphone signal itself in case this noise reference microphone is far away from the other microphones and does not contain the desired speech. As another example, the beamformer 303 may be arranged to generate a second beam having a null in the direction of the maximum of the beam generating the beamformed audio output signal, and the noise reference may be generated as the audio captured by this complementary beam.

In some embodiments, the beamformer 303 may comprise two sub-beamformers which individually may generate different beams. In such an example, one of the sub-beamformers may be arranged to generate the beamformed audio output signal whereas the other sub-beamformer may be arranged to generate the noise reference signal. For example, the first sub-beamformer may be arranged to maximize the output signal resulting in the dominant source being captured whereas the second sub-beamformer may be arranged to minimize the output level thereby typically resulting in a null being generated towards the dominant source. Thus, the latter beamformed signal may be used as a noise reference.

In some embodiments, the two sub-beamformers may be coupled and use different microphones of the microphone array 301. Thus, in some embodiments, the microphone array 301 may be formed by two (or more) microphone sub-arrays, each of which are coupled to a different sub-beamformer and arranged to individually generate a beam. Indeed, in some embodiments, the sub-arrays may even be positioned remote from each other and may capture the audio environment from different positions. Thus, the beamformed audio output signal may be generated from a microphone sub-array at one position whereas the noise reference signal is generated from a microphone sub-array at a different position (and typically in a different device).

In some embodiments, post-processing such as the noise suppression of FIG. 1, may by the output processor 305 be applied to the output of the audio capturing apparatus. This may improve performance for e.g. voice communication. In such post-processing, non-linear operations may be included although it may e.g. for some speech recognizers be more advantageous to limit the processing to only include linear processing.

In many embodiments, it may be desirable to estimate whether a point audio source is present in the beamformed audio output generated by the beamformer 303, i.e. it may be desirable to estimate whether the beamformer 303 has adapted to an audio source such that the beamformed audio output signal comprises a point audio source.

An audio point source may in acoustics be considered to be a source of a sound that originates from a point in space. In many applications, it is desired to detect and capture a point audio source, such as for example a human speaker. In some scenarios, such a point audio source may be a dominant audio source in an acoustic environment but in other embodiments, this may not be the case, i.e. a desired point audio source may be dominated e.g. by diffuse background noise.

A point audio source has the property that the direct path sound will tend to arrive at the different microphones with a strong correlation, and indeed typically the same signal will be captured with a delay (frequency domain linear phase variation) corresponding to the differences in the path length. Thus, when considering the correlation between the signals captured by the microphones, a high correlation indicates a dominant point source whereas a low correlation indicates that the captured audio is received from many uncorrelated sources. Indeed, a point audio source in the audio environment could be considered one for which a direct signal component results in high correlation for the microphone signals, and indeed a point audio source could be considered to correspond to a spatially correlated audio source.

However, whereas it may be possible to seek to detect the presence of a point audio source by determining correlations for the microphone signals, this tends to be inaccurate and to not provide optimum performance. For example, if the point audio source (and indeed the direct path component) is not dominant, the detection will tend to be inaccurate. Thus, the approach is not suitable for e.g. point audio sources that are far from the microphone array (specifically outside the reverberation radius) or where there are high levels of e.g. diffuse noise. Also, such an approach would merely indicate whether a point audio source is present but not reflect whether the beamformer has adapted to that point audio source.

The audio capturing apparatus of FIG. 3 comprises a point audio source detector 307 which is arranged to generate a point audio source estimate indicative of whether the beamformed audio output signal comprises a point audio source or not. The point audio source detector 307 does not determine correlations for the microphone signals but instead determines a point audio source estimate based on the beamformed audio output signal and the noise reference signal generated by the beamformer 303.

The point audio source detector 307 comprises a first transformer 309 arranged to generate a first frequency domain signal by applying a frequency transform to the beamformed audio output signal. Specifically, the beamformed audio output signal is divided into time segments/intervals. Each time segment/interval comprises a group of samples which are transformed, e.g. by an FFT, into a group of frequency domain samples. Thus, the first frequency domain signal is represented by frequency domain samples where each frequency domain sample corresponds to a specific time interval (the corresponding processing frame) and a specific frequency interval. Each such frequency interval and time interval is typically in the field known as a time frequency tile. Thus, the first frequency domain signal is represented by a value for each of a plurality of time frequency tiles, i.e. by time frequency tile values.

The point audio source detector 307 further comprises a second transformer 311 which receives the noise reference signal. The second transformer 311 is arranged to generate a second frequency domain signal by applying a frequency transform to the noise reference signal. Specifically, the noise reference signal is divided into time segments/intervals. Each time segment/interval comprises a group of samples which are transformed, e.g. by an FFT, into a group of frequency domain samples. Thus, the second frequency domain signal is represented a value for each of a plurality of time frequency tiles, i.e. by time frequency tile values.

Figure 5:
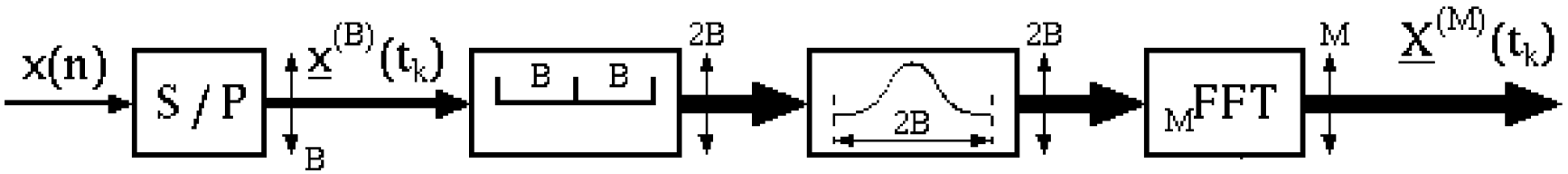
FIG. 5 illustrates an example of a frequency domain transformer.

FIG. 5 illustrates a specific example of functional elements of possible implementations of the first and second transform units 309, 311. In the example, a serial to parallel converter generates overlapping blocks (frames) of 2B samples which are then Hanning windowed and converted to the frequency domain by a Fast Fourier Transform (FFT).

The beamformed audio output signal and the noise reference signal are in the following referred to as z(n) and x(n) respectively and the first and second frequency domain signals are referred to by the vectors $\underline{Z}^{(M)}(t_k)$ and $\underline{X}^{(M)}(t_k)$ (each vector comprising all M frequency tile values for a given processing/transform time segment/frame).

When in use, z(n) is assumed to comprise noise and speech whereas x(n) is assumed to ideally comprise noise only. Furthermore, the noise components of z(n) and x(n) are assumed to be uncorrelated (The components are assumed to be uncorrelated in time. However, there is assumed to typically be a relation between the average amplitudes and this relation may be represented by a coherence term as will be described later). Such assumptions tend to be valid in some scenarios; and specifically in many embodiments, the beamformer 303 may as in the example of FIG. 1 comprise an adaptive filter which attenuates or removes the noise in the beamformed audio output signal which is correlated with the noise reference signal.

Following the transformation to the frequency domain, the real and imaginary components of the time frequency values are assumed to be Gaussian distributed. This assumption is typically accurate e.g. for scenarios with noise originating from diffuse sound fields, for sensor noise, and for a number of other noise sources experienced in many practical scenarios.

The first transformer 309 and the second transformer 311 are coupled to a difference processor 313 which is arranged to generate a time frequency tile difference measure for the individual tile frequencies. Specifically, it can for the current frame for each frequency bin resulting from the FFTs generate a difference measure. The difference measure is generated from the corresponding time frequency tile values of the beamformed audio output signal and the noise reference signals, i.e. of the first and second frequency domain signals.

In particular, the difference measure for a given time frequency tile is generated to reflect a difference between a first monotonic function of a norm of the time frequency tile value of the first frequency domain signal (i.e. of the beamformed audio output signal) and a second monotonic function of a norm of the time frequency tile value of the second frequency domain signal (the noise reference signal). The first and second monotonic functions may be the same or may be different.

The norms may typically be an L1 norm or an L2 norm. This, in most embodiments, the time frequency tile difference measure may be determined as a difference indication reflecting a difference between a monotonic function of a magnitude or power of the value of the first frequency domain signal and a monotonic function of a magnitude or power of the value of the second frequency domain signal.

The monotonic functions may typically both be monotonically increasing but may in some embodiments both be monotonically decreasing.

It will be appreciated that different difference measures may be used in different embodiments. For example, in some embodiments, the difference measure may simply be determined by subtracting the results of the first and second functions from each other. In other embodiments, they may be divided by each other to generate a ratio indicative of the difference etc.

The difference processor 313 accordingly generates a time frequency tile difference measure for each time frequency tile with the difference measure being indicative of the relative level of respectively the beamformed audio output signal and the noise reference signal at that frequency.

The difference processor 313 is coupled to a point audio source estimator 315 which generates the point audio source estimate in response to a combined difference value for time frequency tile difference measures for frequencies above a frequency threshold. Thus, the point audio source estimator 315 generates the point audio source estimate by combining the frequency tile difference measures for frequencies over a given frequency. The combination may specifically be a summation, or e.g. a weighted combination which includes a frequency dependent weighting, of all time frequency tile difference measures over a given threshold frequency.

The point audio source estimate is thus generated to reflect the relative frequency specific difference between the levels of the beamformed audio output signal and the noise reference signal over a given frequency. The threshold frequency may typically be above 500 Hz.

The inventors have realized that such a measure provides a strong indication of whether a point audio source is comprised in the beamformed audio output signal or not. Indeed, they have realized that the frequency specific comparison, together with the restriction to higher frequencies, in practice provides an improved indication of the presence of point audio source. Further, they have realized that the estimate is suitable for application in acoustic environments and scenarios where conventional approaches do not provide accurate results. Specifically, the described approach may provide advantageous and accurate detection of point audio sources even for non-dominant point audio source that are far from the microphone array 301 (and outside the reverberation radius) and in the presence of strong diffuse noise.

In many embodiments, the point audio source estimator 315 may be arranged to generate the point audio source estimate to simply indicate whether a point audio source has been detected or not. Specifically, the point audio source estimator 315 may be arranged to indicate that the presence of a point audio source in the beamformed audio output signal has been detected of the combined difference value exceeds a threshold. Thus, if the generated combined difference value indicates that the difference is higher than a given threshold, then it is considered that a point audio source has been detected in the beamformed audio output signal. If the combined difference value is below the threshold, then it is considered that a point audio source has not been detected in the beamformed audio output signal.

The described approach may thus provide a low complexity detection of whether the generated beamformed audio output signal includes a point source or not.

It will be appreciated that such a detection can be used for many different applications and scenarios, and indeed can be used in many different ways.

For example, as previously mentioned, the point audio source estimate/detection may be used by the output processor 305 in adapting the output audio signal. As a simple example, the output may be muted unless a point audio source is detected in the beamformed audio output signal. As another example, the operation of the output processor 305 may be adapted in response to the point audio source estimate. For example, the noise suppression may be adapted depending on the likelihood of a point audio source being present.

In some embodiments, the point audio source estimate may simply be provided as an output signal together with the audio output signal. For example, in a speech capture system, the point audio source may be considered to be a speech presence estimate and this may be provided together with the audio signal. A speech recognizer may be provided with the audio output signal and may e.g. be arranged to perform speech recognition in order to detect voice commands. The speech recognizer may be arranged to only perform speech recognition when the point audio source estimate indicates that a speech source is present.

In the example of FIG. 3, the audio capturing apparatus comprises an adaptation controller 317 which is fed the point audio source estimate and which may be arranged to control the adaptation performance of the beamformer 303 dependent on the point audio source estimate. For example, in some embodiments, the adaptation of the beamformer 303 may be restricted to times at which the point audio source estimate indicates that a point audio source is present. This may assist the beamformer 303 in adapting to a desired point audio source and reduce the impact of noise etc. It will be appreciated that as will be described later, the point audio source estimate may advantageously be used for more complex adaptation control.

In the following, a specific example of a highly advantageous determination of a point audio source estimate will be described.

In the example, the beamformer 303 may as previously described adapt to focus on a desired audio source, and specifically to focus on a speech source. It may provide a beamformed audio output signal which is focused on the source, as well as a noise reference signal that is indicative of the audio from other sources. The beamformed audio output signal is denoted as z(n) and the noise reference signal as x(n). Both z(n) and x(n) may typically be contaminated with noise, such as specifically diffuse noise. Whereas the following description will focus on speech detection, it will be appreciated that it applies to point audio sources in general.

Let $Z(t_k,\omega_l)$ be the (complex) first frequency domain signal corresponding to the beamformed audio output signal. This signal consists of the desired speech signal $Z_s(t_k, \omega_l)$ and a noise signal $Z_n(t_k,\omega_l)$:

$$Z(t_k,\omega_l)=Z_s(t_k,\omega_l)+Z_n(t_k,\omega_l)$$

If the amplitude of $Z_n(t_k,\omega_l)$ were known, it would be possible to derive a variable d as follows:

$$d(t_k,\omega_l)=|Z(t_k,\omega_l)|-|Z_n(t_k,\omega_l)|,$$

which is representative of the speech amplitude $|Z_s(t_k,\omega_l)|$.

The second frequency domain signal, i.e. the frequency domain representation of the noise reference signal x(n), may be denoted by $X_n(t_k,\omega_l)$.

$z_n(n)$ and x(n) can be assumed to have equal variances as they both represent diffuse noise and are obtained by adding ($z_n$) or subtracting ($x_n$) signals with equal variances, it follows that the real and imaginary parts of $Z_n(t_k,\omega_l)$ and $X_n(t_k,\omega_l)$ also have equal variances. Therefore, $|Z_n(t_k,\omega_l)|$ can be substituted by $|X_n(t_k,\omega_l)|$ in the above equation.

In the case when no speech is present (and thus $Z(t_k,\omega_l)=Z_n(t_k,\omega_l)$), this leads to:

$$d(t_k,\omega_l)=|Z_n(t_k,\omega_l)|-|X_n(t_k,\omega_l)|,$$

where $|Z_n(t_k,\omega_l)|$ and $|X_n(t_k,\omega_l)|$ will be Rayleigh distributed, since the real and imaginary parts are Gaussian distributed and independent.

The mean of the difference of two stochastic variables equals the difference of the means, and thus the mean value of the time frequency tile difference measure above will be zero:

$$E\{d\}=0.$$

The variance of the difference of two stochastic signals equals the sum of the individual variances, and thus:

$$\mathrm{var}(d)=(4-\pi)\sigma^2.$$

Now the variance can be reduced by averaging $|Z_n(t_k,\omega_l)|$ and $|X_n(t_k,\omega_l)|$ over L independent values in the $(t_k,\omega_l)$ plane giving $$\bar{d}=\overline{|Z(t_k,\omega_l)|}-\overline{|X(t_k,\omega_l)|}.$$

Smoothing (low pass filtering) does not change the mean, so we have:

$$E\{\bar{d}\}=0.$$

The variance of the difference of two stochastic signals equals the sum of the individual variances:

$$\mathrm{var}(\bar{d}) = \frac{(4-\pi)\sigma^2}{L}.$$

The averaging thus reduces the variance of the noise.

Thus, the average value of the time frequency tile difference measured when no speech is present is zero. However, in the presence of speech, the average value will increase. Specifically, averaging over L values of the speech component will have much less effect, since all the elements of $|Z_s(t_k,\omega_l)|$ will be positive and $$E\{|Z_s(t_k,\omega_l)|\}>0.$$

Thus, when speech is present, the average value of the time frequency tile difference measure above will be above zero:

$$E\{\bar{d}\}>0.$$

The time frequency tile difference measure may be modified by applying a design parameter in the form of over-subtraction factor γ which is larger than 1:

$$\bar{d}=\overline{|Z(t_k,\omega_l)|}-\gamma\overline{|X(t_k,\omega_l)|}.$$

In this case, the mean value $E\{\bar{d}\}$ will be below zero when no speech is present. However, the over-subtraction factor γ may be selected such that the mean value $E\{\bar{d}\}$ in the presence of speech will tend to be above zero.

In order to generate a point audio source estimate, the time frequency tile difference measures for a plurality of time frequency tiles may be combined, e.g. by a simple summation. Further, the combination may be arranged to include only time frequency tiles for frequencies above a first threshold and possibly only for time frequency tiles below a second threshold.

Specifically, the point audio source estimate may be generated as:

$$e(t_k) = \sum_{\omega_l=\omega_{low}}^{\omega_l=\omega_{high}} \bar{d}(t_k, \omega_l).$$

This point audio source estimate may be indicative of the amount of energy in the beamformed audio output signal from a desired speech source relative to the amount of energy in the noise reference signal. It may thus provide a particularly advantageous measure for distinguishing speech from diffuse noise. Specifically, a speech source may be considered to only found to be present if $e(t_k)$ is positive. If $e(t_k)$ is negative, it is considered that no desired speech source is found.

It should be appreciated that the determined point audio source estimate is not only indicative of whether a point audio source, or specifically a speech source, is present in the capture environment but specifically provides an indication of whether this is indeed present in the beamformed audio output signal, i.e. it also provides an indication of whether the beamformer 303 has adapted to this source.

Indeed, if the beamformer 303 is not completely focused on the desired speaker, part of the speech signal will be present in the noise reference signal x(n). For the adaptive beamformers of U.S. Pat. Nos. 7,146,012 and 7,602,926, it is possible to show that the sum of the energies of the desired source in the microphone signals is equal to the sum of the energies in the beamformed audio output signal and the energies in the noise reference signal(s). In case the beam is not completely focused, the energy in the beamformed audio output signal will decrease and the energy in the noise reference(s) will increase. This will result in a significant lower value for $e(t_k)$ when compared to a beamformer that is completely focused. In this way a robust discriminator can be realized.

It will be appreciated that whereas the above description exemplifies the background and benefits of the approach of the system of FIG. 3, many variations and modifications can be applied without detracting from the approach.

It will be appreciated different functions and approaches for determining the difference measure reflecting a difference between e.g. magnitudes of the beamformed audio output signal and the noise reference signal may be used in different embodiments. Indeed, using different norms or applying different functions to the norms may provide different estimates with different properties but may still result in difference measures that are indicative of the underlying differences between the beamformed audio output signal and the noise reference signal in the given time frequency tile.

Thus, whereas the previously described specific approaches may provide particularly advantageous performance in many embodiments, many other functions and approaches may be used in other embodiments depending on the specific characteristics of the application.

More generally, the difference measure may be calculated as:

$$d(t_k,\omega_l)=f_1(|Z(t_k,\omega_l)|)-f_2(|X(t_k,\omega_l)|)$$

where $f_1(x)$ and $f_2(x)$ can be selected to be any monotonic functions suiting the specific preferences and requirements of the individual embodiment. Typically, the functions $f_1(x)$ and $f_2(x)$ will be monotonically increasing or decreasing functions. It will also be appreciated that rather than merely using the magnitude, other norms (e.g. an L2 norm) may be used.

The time frequency tile difference measure is in the above example indicative of a difference between a first monotonic function $f_1(x)$ of a magnitude (or other norm) time frequency tile value of the first frequency domain signal and a second monotonic function $f_2(x)$ of a magnitude (or other norm) time frequency tile value of the second frequency domain signal. In some embodiments, the first and second monotonic functions may be different functions. However, in most embodiments, the two functions will be equal.

Furthermore, one or both of the functions $f_1(x)$ and $f_2(x)$ may be dependent on various other parameters and measures, such as for example an overall averaged power level of the microphone signals, the frequency, etc.

In many embodiments, one or both of the functions $f_1(x)$ and $f_2(x)$ may be dependent on signal values for other frequency tiles, for example by an averaging of one or more of $Z(t_k,\omega_l)$, $|Z(t_k,\omega_l)|$, $f_1(|Z(t_k,\omega_l)|)$, $X(t_k,\omega_l)$, $|X(t_k,\omega_l)|$, or $f_2(|X(t_k,\omega_l)|)$ over other tiles in in the frequency and/or time dimension (i.e. averaging of values for varying indexes of k and/or l). In many embodiments, an averaging over a neighborhood extending in both the time and frequency dimensions may be performed. Specific examples based on the specific difference measure equations provided earlier will be described later but it will be appreciated that corresponding approaches may also be applied to other algorithms or functions determining the difference measure.

Examples of possible functions for determining the difference measure include for example:

$$d(t_k,\omega_l)=|Z(t_k,\omega_l)|^{\alpha}-\gamma\cdot|X(t_k,\omega_l)|^{\beta}$$

where $\alpha$ and $\beta$ are design parameters with typically $\alpha=\beta$, such as e.g. in:

$$d(t_k,\omega_l)=\sqrt{|Z(t_k,\omega_l)|}-\gamma\cdot\sqrt{|X(t_k,\omega_l)|};$$

$$d(t_k,\omega_l)=\sum_{n=k-4}^{k+3}|Z(t_n,\omega_l)|-\gamma\cdot\sum_{n=k-4}^{k+3}|X(t_k,\omega_l)|$$

$$d(t_k,\omega_l)=\{|Z(t_k,\omega_l)|-\gamma\cdot|X(\mathrm{t_k},\omega_\mathrm{l})|\}\cdot\sigma(\omega_l)$$

where $\sigma(\omega_l)$ is a suitable weighting function used to provide desired spectral characteristics of the difference measure and the point audio source estimate.

It will be appreciated that these functions are merely exemplary and that many other equations and algorithms for calculating a distance measure can be envisaged.

In the above equations, the factor $\gamma$ represents a factor which is introduced to bias the difference measure towards negative values. It will be appreciated that whereas the specific examples introduce this bias by a simple scale factor applied to the noise reference signal time frequency tile, many other approaches are possible.

Indeed, any suitable way of arranging the first and second functions $f_1(x)$ and $f_2(x)$ in order to provide a bias towards negative values may be used. The bias is specifically, as in the previous examples, a bias that will generate expected values of the difference measure which are negative if there is no speech. Indeed, if both the beamformed audio output signal and the noise reference signal contain only random noise (e.g. the sample values may be symmetrically and randomly distributed around a mean value), the expected value of the difference measure will be negative rather than zero. In the previous specific example, this was achieved by the oversubtraction factor $\gamma$ which resulted in negative values when there is no speech.

Figure 6:
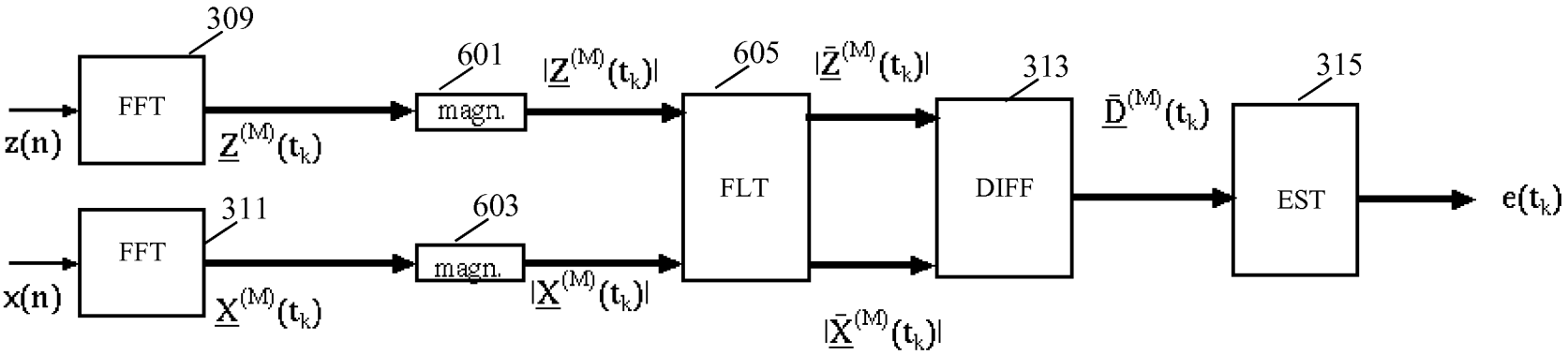
FIG. 6 illustrates an example of elements of a difference processor for an audio capturing apparatus in accordance with some embodiments of the invention.

An example of a point audio source detector 307 based on the described considerations is provided in FIG. 6. In the example, the beamformed audio output signal and the noise reference signal are provided to the first transformer 309 and the second transformer 311 which generate the corresponding first and second frequency domain signals.

The frequency domain signals are generated e.g. by computing a short-time Fourier transform (STFT) of e.g. overlapping Hanning windowed blocks of the time domain signal. The STFT is in general a function of both time and frequency, and is expressed by the two arguments $t_k$ and $\omega_l$ with $t_k=kB$ being the discrete time, and where k is the frame index, B the frame shift, and $\omega_l=l\ \omega_0$ is the (discrete) frequency, with l being the frequency index and $\omega_0$ denoting the elementary frequency spacing.

After this frequency domain transformation the frequency domain signals represented by vectors $\underline{Z}^{(M)}(t_k)$ and $\underline{X}^{(M)}(t_k)$ respectively of length are thus provided.

The frequency domain transformation is in the specific example fed to magnitude units 601, 603 which determine and outputs the magnitudes of the two signals, i.e. they generate the values $$|\underline{Z}^{(M)}(t_k)| \text{ and } |\underline{X}^{(M)}(t_k)|.$$

In other embodiments, other norms may be used and the processing may include applying monotonic functions.

The magnitude units 601, 603 are coupled to a low pass filter 605 which may smooth the magnitude values. The filtering/smoothing may be in the time domain, the frequency domain, or often advantageously both, i.e. the filtering may extend in both the time and frequency dimensions.

The filtered magnitude signals/vectors $\overline{|\underline{Z}^{(M)}(t_k)|}$ and $\overline{|\underline{X}^{(M)}(t_k)|}$ will also be referred to as $|^{(M)}(t_k)|$ and $|\check{\underline{X}}^{(M)}(t_k)|$.

The filter 605 is coupled to the difference processor 313 which is arranged to determine the time frequency tile difference measures. As a specific example, the difference processor 313 may generate the time frequency tile difference measures as:

$$\overline{d}(t_k,\omega_l)=\overline{|Z(t_k,\omega_l)|}-\gamma_n\overline{|X(t_k,\omega_l)|}$$

The design parameter $\gamma_n$ may typically be in the range of 1 . . . 2.

The difference processor 313 is coupled to the point audio source estimator 315 which is fed the time frequency tile difference measures and which in response proceeds to determine the point audio source estimate by combining these.

Specifically, the sum of the time frequency tile difference measures $\overline{d}(t_k,\omega_l)$ for frequency values between $\omega_l=\omega_{low}$ and $\omega_l=\omega_{high}$ may be determined as:

$$e(t_k)=\sum_{\omega_l=\omega_{low}}^{\omega_l=\omega_{high}}\overline{d}(t_k,\omega_l).$$

In some embodiments, this value may be output from the point audio source detector 307. In other embodiments, the determined value may be compared to a threshold and used to generate e.g. a binary value indicating whether a point audio source is considered to be detected or not. Specifically, the value $e(t_k)$ may be compared to the threshold of zero, i.e. if the value is negative it is considered that no point audio source has been detected and if it is positive it is considered that a point audio source has been detected in the beamformed audio output signal.

In the example, the point audio source detector 307 included low pass filtering/averaging for the magnitude time frequency tile values of the beamformed audio output signal and for the magnitude time frequency tile values of the noise reference signal. The smoothing may specifically be performed by performing an averaging over neighboring values. For example, the following low pass filtering may be applied to the first frequency domain signal:

$$\overline{|Z(t_k,\omega_l)|}=\Sigma_{m=0}^{2}\Sigma_{n=-1}^{N}|Z(t_{k-m},\omega_{l-n})|*W(m,n),$$

where (with N=1) W is a 3*3 matrix with weights of ⅑. It will be appreciated that other values of N can of course be used, and similarly different time intervals can be used in other embodiments. Indeed, the size over which the filtering/smoothing is performed may be varied, e.g. in dependence on the frequency (e.g. a larger kernel is applied for higher frequencies than for lower frequencies).

Indeed, it will be appreciated that the filtering may be achieved by applying a kernel having a suitable extension in both the time direction (number of neighboring time frames considered) and in the frequency direction (number of neighboring frequency bins considered), and indeed that the size of thus kernel may be varied e.g. for different frequencies or for different signal properties.

Also, different kernels, as represented by W(m,n) in the above equation may be varied, and this may similarly be a dynamic variations, e.g. for different frequencies or in response to signal properties.

The filtering not only reduces noise and thus provides a more accurate estimation but it in particular increases the differentiation between speech and noise. Indeed, the filtering will have a substantially higher impact on noise than on a point audio source resulting in a larger difference being generated for the time frequency tile difference measures.

The correlation between the beamformed audio output signal and the noise reference signal(s) for beamformers such as that of FIG. 1 were found to reduce for increasing frequencies. Accordingly, the point audio source estimate is generated in response to only time frequency tile difference measures for frequencies above a threshold. This results in increased decorrelation and accordingly a larger difference between the beamformed audio output signal and the noise reference signal when speech is present. This results in a more accurate detection of point audio sources in the beamformed audio output signal.

In many embodiments, advantageous performance has been found by limiting the point audio source estimate to be based only on time frequency tile difference measures for frequencies not below 500 Hz, or in some embodiments advantageously not below 1 kHz or even 2 kHz.

However, in some applications or scenarios, a significant correlation between the beamformed audio output signal and the noise reference signal may remain for even relatively high audio frequencies, and indeed in some scenarios for the entire audio band.

Indeed, in an ideal spherically isotropic diffuse noise field, the beamformed audio output signal and the noise reference signal will be partially correlated, with the consequence that the expected values of $|Z_n(t_k,\omega_l)|$ and $|X_n(t_k,\omega_l)|$ will not be equal, and therefore $|Z_n(t_k,\omega_l)|$ cannot readily be replaced by $|X_n(t_k,\omega_l)|$.

This can be understood by looking at the characteristics of an ideal spherically isotropic diffuse noise field. When two microphones are placed in such a field at distance d apart and have microphone signals $U(t_k,\omega_l)$ and $U_2(t_k,\omega_l)$ respectively, we have:

$$E\{|U_1(t_k,\omega)|^2\} = E\{|U_2(t_k,\omega)|^2\} = 2\sigma^2$$

and $$E\{U_1(t_k,\omega)\cdot U_2^*(t_k,\omega)\} = 2\sigma^2\frac{\sin(kd)}{kd} = 2\sigma^2 sinc(kd),$$

with the wave number $k=\omega/c$ (c is the velocity of sound) and $\sigma^2$ the variance of the real and imaginary parts of $U_1(t_k,\omega_l)$ and $U_2(t_k,\omega_l)$, which are Gaussian distributed.

Suppose the beamformer is a simple 2-microphone Delay-and-Sum beamformer and forms a broadside beam (i.e. the delays are zero).

We can write:

$$Z(t_k,\omega_l)=U_1(t_k,\omega_l)+U_2(t_k,\omega_l),$$

and for the noise reference signal:

$$X(t_k,\omega_l)=U_1(t_k,\omega_l)-U_2(t_k,\omega_l).$$

For the expected values we get, assuming only noise is present:

$$E\{|Z(t_k,\omega)|^2\} = E\{|U_1(t_k,\omega)|^2\} + E\{|U_2(t_k,\omega)|^2\} + 2\,\mathrm{Re}(E\{U_1(t_k,\omega).U_2^*(t_k,\omega)\} = 4\sigma^2 + 4\sigma^2 sinc(kd) = 4\sigma^2(1+sinc(kd)).$$

Similarly we get for $E\{|X(t_k,\omega)|^2\}$:

$$E\{|X(t_k,\omega)|^2\}=4\sigma^2(1-\sin c(kd)).$$

Thus for the low frequencies $|Z_n(t_k,\omega_l)|$ and $|X_n(t_k,\omega_l)|$ will not be equal.

In some embodiments, the point audio source detector 307 may be arranged to compensate for such correlation. In particular, the point audio source detector 307 may be arranged to determine a noise coherence estimate $C(t_k,\omega_l)$ which is indicative of a correlation between the amplitude of the noise reference signal and the amplitude of a noise component of the beamformed audio output signal. The determination of the time frequency tile difference measures may then be as a function of this coherence estimate.

Indeed, in many embodiments, the point audio source detector 307 may be arranged to determine a coherence for the beamformed audio output signal and the noise reference signal from the beamformer based on the ratio between the expected amplitudes:

$$C(t_k,\omega_l) = \frac{E\{|Z_n(t_k,\omega_l)|\}}{E\{|X_n(t_k,\omega_l)|\}},$$

where $E\{\bullet\}$ is the expectation operator. The coherence term is an indication of the average correlation between the amplitudes of the noise component in the beamformed audio output signal and the amplitudes of the noise reference signal.

Since $C(t_k,\omega_l)$ is not dependent on the instantaneous audio at the microphones but instead depends on the spatial characteristics of the noise sound field, the variation of $C(t_k,\omega_l)$ as a function of time is much less than the time variations of $Z_n$ and $X_n$.

As a result $C(t_k,\omega_l)$ can be estimated relatively accurately by averaging $|Z_n(t_k,\omega_l)|$ and $|X_n(t_k,\omega_l)|$ over time during the periods where no speech is present. An approach for doing so is disclosed in U.S. Pat. No. 7,602,926, which specifically describes a method where no explicit speech detection is needed for determining $C(t_k,\omega_l)$.

It will be appreciated that any suitable approach for determining the noise coherence estimate $C(t_k,\omega_l)$ may be used. For example, a calibration may be performed where the speaker is instructed not to speak with the first and second frequency domain signal being compared and with the noise correlation estimate $C(t_k,\omega_l)$ for each time frequency tile simply being determined as the average ratio of the time frequency tile values of the first frequency domain signal and the second frequency domain signal. For an ideal spherically isotropic diffuse noise field the coherence function can also be analytically be determined following the approach described above.

Based on this estimate $|Z_f(t_k,\omega_l)|$ can be replaced by $C(t_k,\omega_l)|X_n(t_k,\omega_l)|$ rather than just $|X_n(t_k,\omega_l)|$. This may result in time frequency tile difference measures given by:

$$\bar{d}=\overline{|Z(t_k,\omega_l)|}-\gamma\overline{C(t_k,\omega_l)|X(t_k,\omega_l)|}.$$

Thus, the previous time frequency tile difference measure can be considered a specific example of the above difference measure with the coherence function set to a constant value of 1.

The use of the coherence function may allow the approach to be used at lower frequencies, including at frequencies where there is a relatively strong correlation between the beamformed audio output signal and the noise reference signal.

It will be appreciated that the approach may further advantageously in many embodiments further include an adaptive canceller which is arranged to cancel a signal component of the beamformed audio output signal which is correlated with the at least one noise reference signal. For example, similarly to the example of FIG. 1, an adaptive filter may have the noise reference signal as an input and with the output being subtracted from the beamformed audio output signal. The adaptive filter may e.g. be arranged to minimize the level of the resulting signal during time intervals where no speech is present.

In the following an audio capturing apparatus will be described in which the point audio source estimate and point audio source detector 307 interworks with the other described elements to provide a particularly advantageous audio capturing system. In particular, the approach is highly suitable for capturing audio sources in noisy and reverberant environments. It provides particularly advantageous performance for applications wherein a desired audio source may be outside the reverberation radius and the audio captured by the microphones may be dominated by diffuse noise and late reflections or reverberations.

Figure 7:
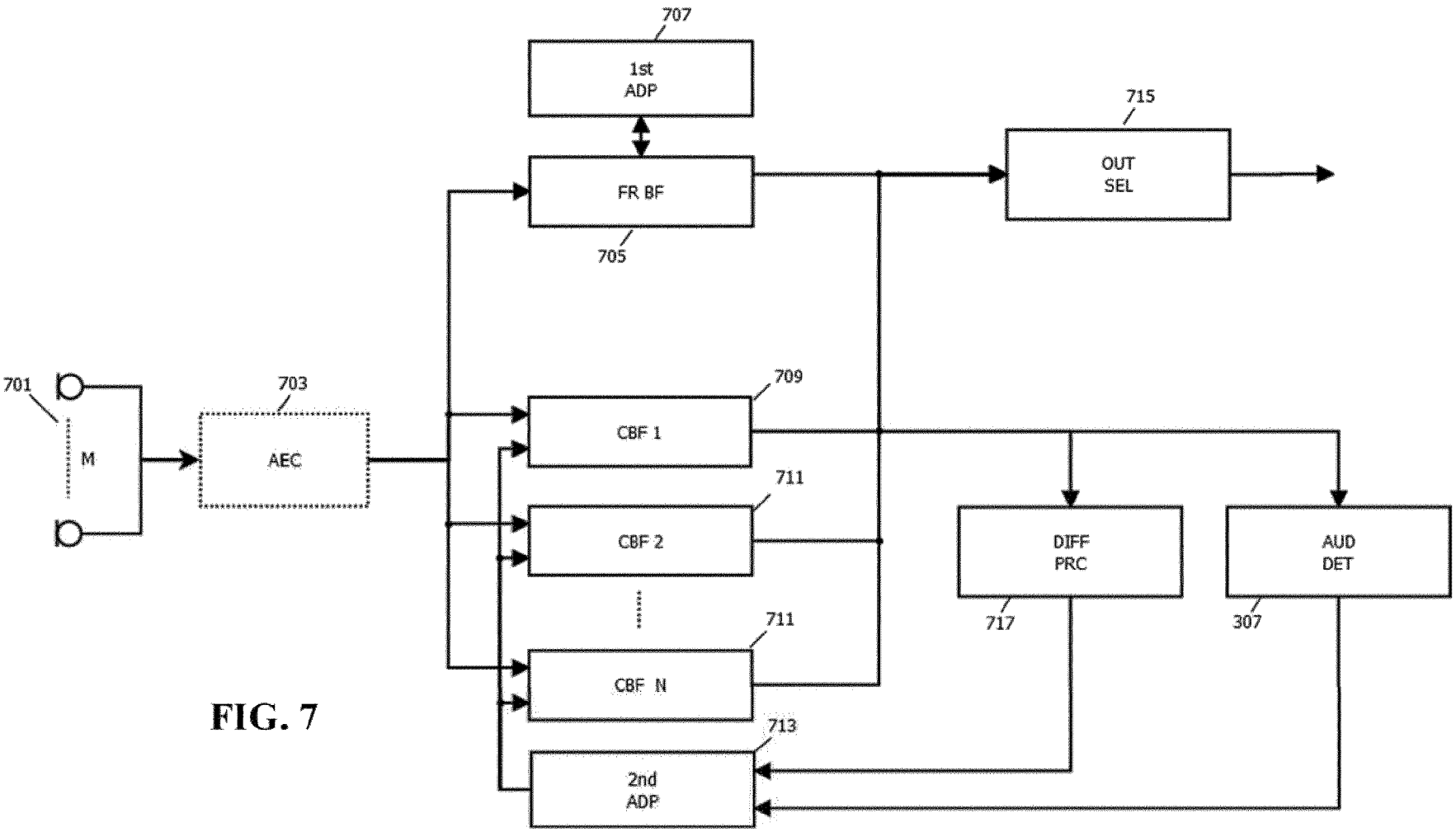
FIG. 7 illustrates an example of elements of an audio capturing apparatus in accordance with some embodiments of the invention.

FIG. 7 illustrates an example of elements of such an audio capturing apparatus in accordance with some embodiments of the invention. The elements and approach of the system of FIG. 3 may correspond to the system of FIG. 7 as set out in the following.

The audio capturing apparatus comprises a microphone array 701 which may directly correspond to the microphone array 301 of FIG. 3. In the example, the microphone array 701 is coupled to an optional echo canceller 703 which may cancel the echoes that originate from acoustic sources (for which a reference signal is available) that are linearly related to the echoes in the microphone signal(s). This source can for example be a loudspeaker. An adaptive filter can be applied with the reference signal as input, and with the output being subtracted from the microphone signal to create an echo compensated signal.

This can be repeated for each individual microphone.

It will be appreciated that the echo canceller 703 is optional and simply may be omitted in many embodiments.

The microphone array 701 is coupled to a first beamformer 705, typically either directly or via the echo canceller 703 (as well as possibly via amplifiers, digital to analog converters etc. as will be well known to the person skilled in the art). The first beamformer 705 may directly correspond to the beamformer 303 of FIG. 3.

The first beamformer 705 is arranged to combine the signals from the microphone array 701 such that an effective directional audio sensitivity of the microphone array 701 is generated. The first beamformer 705 thus generates an output signal, referred to as the first beamformed audio output, which corresponds to a selective capturing of audio in the environment. The first beamformer 705 is an adaptive beamformer and the directivity can be controlled by setting parameters, referred to as first beamform parameters, of the beamform operation of the first beamformer 705.

The first beamformer 705 is coupled to a first adapter 707 which is arranged to adapt the first beamform parameters. Thus, the first adapter 707 is arranged to adapt the parameters of the first beamformer 705 such that the beam can be steered.

In addition, the audio capturing apparatus comprises a plurality of constrained beamformers 709, 711 each of which is arranged to combine the signals from the microphone array 701 such that an effective directional audio sensitivity of the microphone array 701 is generated. Each of the constrained beamformers 709, 711 is thus arranged to generate an audio output, referred to as the constrained beamformed audio output, which corresponds to a selective capturing of audio in the environment. Similarly, to the first beamformer 705, the constrained beamformers 709, 711 are adaptive beamformers where the directivity of each constrained beamformer 709, 711 can be controlled by setting parameters, referred to as constrained beamform parameters, of the constrained beamformers 709, 711.

The audio capturing apparatus accordingly comprises a second adapter 713 which is arranged to adapt the constrained beamform parameters of the plurality of constrained beamformers thereby adapting the beams formed by these.

The beamformer 303 of FIG. 3 may directly correspond to the first constrained beamformer 709 of FIG. 7. It will also be appreciated that the remaining constrained beamformers 711 may correspond to the first beamformer 709 and could be considered instantiations of this.

Both the first beamformer 705 and the constrained beamformers 709, 711 are accordingly adaptive beamformers for which the actual beam formed can be dynamically adapted. Specifically, the beamformers 705, 709, 711 are filter-and-combine (or specifically in most embodiments filter-and-sum) beamformers. A beamform filter may be applied to each of the microphone signals and the filtered outputs may be combined, typically by simply being added together.

It will be appreciated that the beamformer 303 of FIG. 3 may correspond to any of the beamformers 705, 709, 711 and that indeed the comments provided with respect to the beamformer 303 of FIG. 3 apply equally to any of the first beamformer 705 and the constrained beamformers 709, 711 of FIG. 7.

In many embodiments, the structure and implementation of the first beamformer 705 and the constrained beamformers 709, 711 may be the same, e.g. the beamform filters may have identical FIR filter structures with the same number of coefficients etc.

However, the operation and parameters of the first beamformer 705 and the constrained beamformers 709, 711 will be different, and in particular the constrained beamformers 709, 711 are constrained in ways the first beamformer 705 is not. Specifically, the adaptation of the constrained beamformers 709, 711 will be different than the adaptation of the first beamformer 705 and will specifically be subject to some constraints.

Specifically, the constrained beamformers 709, 711 are subject to the constraint that the adaptation (updating of beamform filter parameters) is constrained to situations when a criterion is met whereas the first beamformer 705 will be allowed to adapt even when such a criterion is not met. Indeed, in many embodiments, the first adapter 707 may be allowed to always adapt the beamform filter with this not being constrained by any properties of the audio captured by the first beamformer 705 (or of any of the constrained beamformers 709, 711).

The criterion for adapting the constrained beamformers 709, 711 will be described in more detail later.

In many embodiments, the adaptation rate for the first beamformer 705 is higher than for the constrained beamformers 709, 711. Thus, in many embodiments, the first adapter 707 may be arranged to adapt faster to variations than the second adapter 713, and thus the first beamformer 705 may be updated faster than the constrained beamformers 709, 711. This may for example be achieved by the low pass filtering of a value being maximized or minimized (e.g. the signal level of the output signal or the magnitude of an error signal) having a higher cut-off frequency for the first beamformer 705 than for the constrained beamformers 709, 711. As another example, a maximum change per update of the beamform parameters (specifically the beamform filter coefficients) may be higher for the first beamformer 705 than for the constrained beamformers 709, 711.

Accordingly, in the system, a plurality of focused (adaptation constrained) beamformers that adapt slowly and only when a specific criterion is met is supplemented by a free running faster adapting beamformer that is not subject to this constraint. The slower and focused beamformers will typically provide a slower but more accurate and reliable adaptation to the specific audio environment than the free running beamformer which however will typically be able to quickly adapt over a larger parameter interval.

In the system of FIG. 7, these beamformers are used synergistically together to provide improved performance as will be described in more detail later.

The first beamformer 705 and the constrained beamformers 709, 711 are coupled to an output processor 715 which receives the beamformed audio output signals from the beamformers 705, 709, 711. The exact output generated from the audio capturing apparatus will depend on the specific preferences and requirements of the individual embodiment. Indeed, in some embodiments, the output from the audio capturing apparatus may simply consist in the audio output signals from the beamformers 705, 709, 711.

In many embodiments, the output signal from the output processor 715 is generated as a combination of the audio output signals from the beamformers 705, 709, 711. Indeed, in some embodiments, a simple selection combining may be performed, e.g. selecting the audio output signals for which the signal to noise ratio, or simply the signal level, is the highest.

Thus, the output selection and post-processing of the output processor 715 may be application specific and/or different in different implementations/embodiments. For example, all possible focused beam outputs can be provided, a selection can be made based on a criterion defined by the user (e.g. the strongest speaker is selected), etc.

For a voice control application, for example, all outputs may be forwarded to a voice trigger recognizer which is arranged to detect a specific word or phrase to initialize voice control. In such an example, the audio output signal in which the trigger word or phrase is detected may following the trigger phrase be used by a voice recognizer to detect specific commands.

For communication applications, it may for example be advantageous to select the audio output signal that is strongest and e.g. for which the presence of a specific point audio source has been found.

In some embodiments, post-processing such as the noise suppression of FIG. 1, may be applied to the output of the audio capturing apparatus (e.g. by the output processor 715). This may improve performance for e.g. voice communication. In such post-processing, non-linear operations may be included although it may e.g. for some speech recognizers be more advantageous to limit the processing to only include linear processing.

In the system of FIG. 7, a particularly advantageous approach is taken to capture audio based on the synergistic interworking and interrelation between the first beamformer 705 and the constrained beamformers 709, 711.

For this purpose, the audio capturing apparatus comprises a beam difference processor 717 which is arranged to determine a difference measure between one or more of the constrained beamformers 709, 711 and the first beamformer 705. The difference measure is indicative of a difference between the beams formed by respectively the first beamformer 705 and the constrained beamformer 709, 711. Thus, the difference measure for a first constrained beamformer 709 may indicate the difference between the beams that are formed by the first beamformer 705 and by the first constrained beamformer 709. In this way, the difference measure may be indicative of how closely the two beamformers 705, 709 are adapted to the same audio source.

Different difference measures may be used in different embodiments and applications.

In some embodiments, the difference measure may be determined based on the generated beamformed audio output from the different beamformers 705, 709, 711. As an example, a simple difference measure may simply be generated by measuring the signal levels of the output of the first beamformer 705 and the first constrained beamformer 709 and comparing these to each other. The closer the signal levels are to each other, the lower is the difference measure (typically the difference measure will also increase as a function of the actual signal level of e.g. the first beamformer 705).

A more suitable difference measure may in many embodiments be generated by determining a correlation between the beamformed audio output from the first beamformer 705 and the first constrained beamformer 709. The higher the correlation value, the lower the difference measure.

Alternatively or additionally, the difference measure may be determined on the basis of a comparison of the beamform parameters of the first beamformer 705 and the first constrained beamformer 709. For example, the coefficients of the beamform filter of the first beamformer 705 and the beamform filter of the first constrained beamformer 709 for a given microphone may be represented by two vectors. The magnitude of the difference vector of these two vectors may then be calculated. The process may be repeated for all microphones and the combined or average magnitude may be determined and used as a distance measure. Thus, the generated difference measure reflects how different the coefficients of the beamform filters are for the first beamformer 705 and the first constrained beamformer 709, and this is used as a difference measure for the beams.

Thus, in the system of FIG. 7, a difference measure is generated to reflect a difference between the beamform parameters of the first beamformer 705 and the first constrained beamformer 709 and/or a difference between the beamformed audio outputs of these.

It will be appreciated that generating, determining, and/or using a difference measure is directly equivalent to generating, determining, and/or using a similarity measure. Indeed, one may typically be considered to be a monotonically decreasing function of the other, and thus a difference measure is also a similarity measure (and vice versa) with typically one simply indicating increasing differences by increasing values and the other doing this by decreasing values.

The beam difference processor 717 is coupled to the second adapter 713 and provides the difference measure to this. The second adapter 713 is arranged to adapt the constrained beamformers 709, 711 in response to the difference measure. Specifically, the second adapter 713 is arranged to adapt constrained beamform parameters only for constrained beamformers for which a difference measure has been determined that meets a similarity criterion. Thus, if no difference measure has been determined for a given constrained beamformers 709, 711, or if the determined difference measure for the given constrained beamformer 709, 711 indicates that the beams of the first beamformer 705 and the given constrained beamformer 709, 711 are not sufficiently similar, then no adaptation is performed.

Thus, in the audio capturing apparatus of FIG. 7, the constrained beamformers 709, 711 are constrained in the adaptation of the beams. Specifically, they are constrained to only adapt if the current beam formed by the constrained beamformer 709, 711 is close to the beam that the free running first beamformer 705 is forming, i.e. the individual constrained beamformer 709, 711 is only adapted if the first beamformer 705 is currently adapted to be sufficiently close to the individual constrained beamformer 709, 711.

The result of this is that the adaptation of the constrained beamformers 709, 711 are controlled by the operation of the first beamformer 705 such that effectively the beam formed by the first beamformer 705 controls which of the constrained beamformers 709, 711 is (are) optimized/adapted. This approach may specifically result in the constrained beamformers 709, 711 tending to be adapted only when a desired audio source is close to the current adaptation of the constrained beamformer 709, 711.

The approach of requiring similarity between the beams in order to allow adaptation has in practice been found to result in a substantially improved performance when the desired audio source, the desired speaker in the present case, is outside the reverberation radius. Indeed, it has been found to provide highly desirable performance for, in particular, weak audio sources in reverberant environments with a non-dominant direct path audio component.

In many embodiments, the constraint of the adaptation may be subject to further requirements.

For example, in many embodiments, the adaptation may be a requirement that a signal to noise ratio for the beamformed audio output exceeds a threshold. Thus, the adaptation for the individual constrained beamformer 709, 711 may be restricted to scenarios wherein this is sufficiently adapted and the signal on basis of which the adaptation is based reflects the desired audio signal.

It will be appreciated that different approaches for determining the signal to noise ratio may be used in different embodiments. For example, the noise floor of the microphone signals can be determined by tracking the minimum of a smoothed power estimate and for each frame or time interval the instantaneous power is compared with this minimum. As another example, the noise floor of the output of the beamformer may be determined and compared to the instantaneous output power of the beamformed output.

In some embodiments, the adaptation of a constrained beamformer 709, 711 is restricted to when a speech component has been detected in the output of the constrained beamformer 709, 711. This will provide improved performance for speech capture applications. It will be appreciated that any suitable algorithm or approach for detecting speech in an audio signal may be used. In particular, the previously described approach of the point audio source detector 307 may be applied.

It will be appreciated that the system of FIGS. 3-7 typically operate using a frame or block processing. Thus, consecutive time intervals or frames are defined and the described processing may be performed within each time interval. For example, the microphone signals may be divided into processing time intervals, and for each processing time interval the beamformers 705, 709, 711 may generate a beamformed audio output signal for the time interval, determine a difference measure, select a constrained beamformers 709, 711, and update/adapt this constrained beamformer 709, 711 etc. Processing time intervals may in many embodiments advantageously have a duration between 7 msec and 70 msec.

It will be appreciated that in some embodiments, different processing time intervals may be used for different aspects and functions of the audio capturing apparatus. For example, the difference measure and selection of a constrained beamformer 709, 711 for adaptation may be performed at a lower frequency than e.g. the processing time interval for beamforming.

In the system, the adaptation is further in dependence on the detection of point audio sources in the beamformed audio outputs. Accordingly, the audio capturing apparatus may further comprise the point audio source detector 307 already described with respect to FIG. 3

The point audio source detector 307 may specifically in many embodiments be arranged to detect point audio sources in the second beamformed audio outputs and accordingly the point audio source detector 307 is coupled to the constrained beamformers 709, 711 and it receives the beamformed audio output signals from these. In addition, it receives the noise reference signals from these (for clarity FIG. 7 illustrates the beamformed audio output signal and the noise reference signal by single lines, i.e. the lines of FIG. 7 may be considered to represent a bus comprising both the beamformed audio output signal and the noise reference signal(s), as well as e.g. beamform parameters).

Thus, the operation of the system of FIG. 7 is dependent on the point audio source estimation performed by the point audio source detector 307 in accordance with the previously described principles. The point audio source detector 307 may specifically be arranged to generate a point audio source estimate for all the beamformers 705, 709, 711.

The detection result is passed from the point audio source detector 307 to the second adapter 713 which is arranged to adapt the adaptation in response to this. Specifically, the second adapter 713 may be arranged to adapt only constrained beamformers 709, 711 for which the point audio source detector 307 indicates that a point audio source has been detected.

Thus, the audio capturing apparatus is arranged to constrain the adaptation of the constrained beamformers 709, 711 such that only constrained beamformers 709, 711 are adapted in which a point audio source is present in the formed beam, and the formed beam is close to that formed by the first beamformer 705. Thus, the adaptation is typically restricted to constrained beamformers 709, 711 which are already close to a (desired) point audio source. The approach allows for a very robust and accurate beamforming that performs exceedingly well in environments where the desired audio source may be outside a reverberation radius. Further, by operating and selectively updating a plurality of constrained beamformers 709, 711, this robustness and accuracy may be supplemented by a relatively fast reaction time allowing quick adaptation of the system as a whole to fast moving or newly occurring sound sources.

In many embodiments, the audio capturing apparatus may be arranged to only adapt one constrained beamformer 709, 711 at a time. Thus, the second adapter 713 may in each adaptation time interval select one of the constrained beamformers 709, 711 and adapt only this by updating the beamform parameters.

The selection of a single constrained beamformers 709, 711 will typically occur automatically when selecting a constrained beamformer 709, 711 for adaptation only if the current beam formed is close to that formed by the first beamformer 705 and if a point audio source is detected in the beam.

However, in some embodiments, it may be possible for a plurality of constrained beamformers 709, 711 to simultaneously meet the criteria. For example, if a point audio source is positioned close to regions covered by two different constrained beamformers 709, 711 (or e.g. it is in an overlapping area of the regions), the point audio source may be detected in both beams and these may both have been adapted to be close to each other by both being adapted towards the point audio source.

Thus, in such embodiments, the second adapter 713 may select one of the constrained beamformers 709, 711 meeting the two criteria and only adapt this one. This will reduce the risk that two beams are adapted towards the same point audio source and thus reduce the risk of the operations of these interfering with each other.

Indeed, adapting the constrained beamformers 709, 711 under the constraint that the corresponding difference measure must be sufficiently low and selecting only a single constrained beamformers 709, 711 for adaptation (e.g. in each processing time interval/frame) will result in the adaptation being differentiated between the different constrained beamformers 709, 711. This will tend to result in the constrained beamformers 709, 711 being adapted to cover different regions with the closest constrained beamformer 709, 711 automatically being selected to adapt/follow the audio source detected by the first beamformer 705. However, in contrast to e.g. the approach of FIG. 2, the regions are not fixed and predetermined but rather are dynamically and automatically formed.

It should also be noted that the regions may be dependent on the beamforming for a plurality of paths and are typically not limited to angular direction of arrival regions. For example, regions may be differentiated based on the distance to the microphone array. Thus, the term region may be considered to refer to positions in space at which an audio source will result in adaptation that meets similarity requirement for the difference measure. It thus includes consideration of not only the direct path but also e.g. reflections if these are considered in the beamform parameters and in particular are determined based on both spatial and temporal aspect (and specifically depend on the full impulse responses of the beamform filters).

The selection of a single constrained beamformer 709, 711 may specifically be in response to a captured audio level. For example, the point audio source detector 307 may determine the audio level of each of the beamformed audio outputs from the constrained beamformers 709, 711 that meet the criteria, and the second adapter 713 may select the constrained beamformer 709, 711 resulting in the highest level. In some embodiments, the second adapter 713 may select the constrained beamformer 709, 711 for which a point audio source detected in the beamformed audio output has the highest value. For example, the point audio source detector 307 may detect a speech component in the beamformed audio outputs from two constrained beamformers 709, 711 and the second adapter 713 may proceed to select the one having the highest level of the speech component.

In many embodiments, the second adapter 713 may select the beamformer 705, 711 based on the point audio source estimate, and specifically may select the beamformer 709, 711 for which the point audio source estimate provides the highest likelihood of a point audio source being present. As a specific example, it may select the beamformer 709, 711 having the highest combined value:

$$e(t_k) = \sum_{\omega_l=\omega_{low}}^{\omega_l=\omega_{high}} \bar{d}(t_k, \omega_l).$$

In the approach, a very selective adaptation of the constrained beamformers 709, 711 is thus performed leading to these only adapting in specific circumstances. This provides a very robust beamforming by the constrained beamformers 709, 711 resulting in improved capture of a desired audio source. However, in many scenarios, the constraints in the beamforming may also result in a slower adaptability and indeed may in many situations result in new audio sources (e.g. new speakers) not being detected or only being very slowly adapted to.

Figure 8:
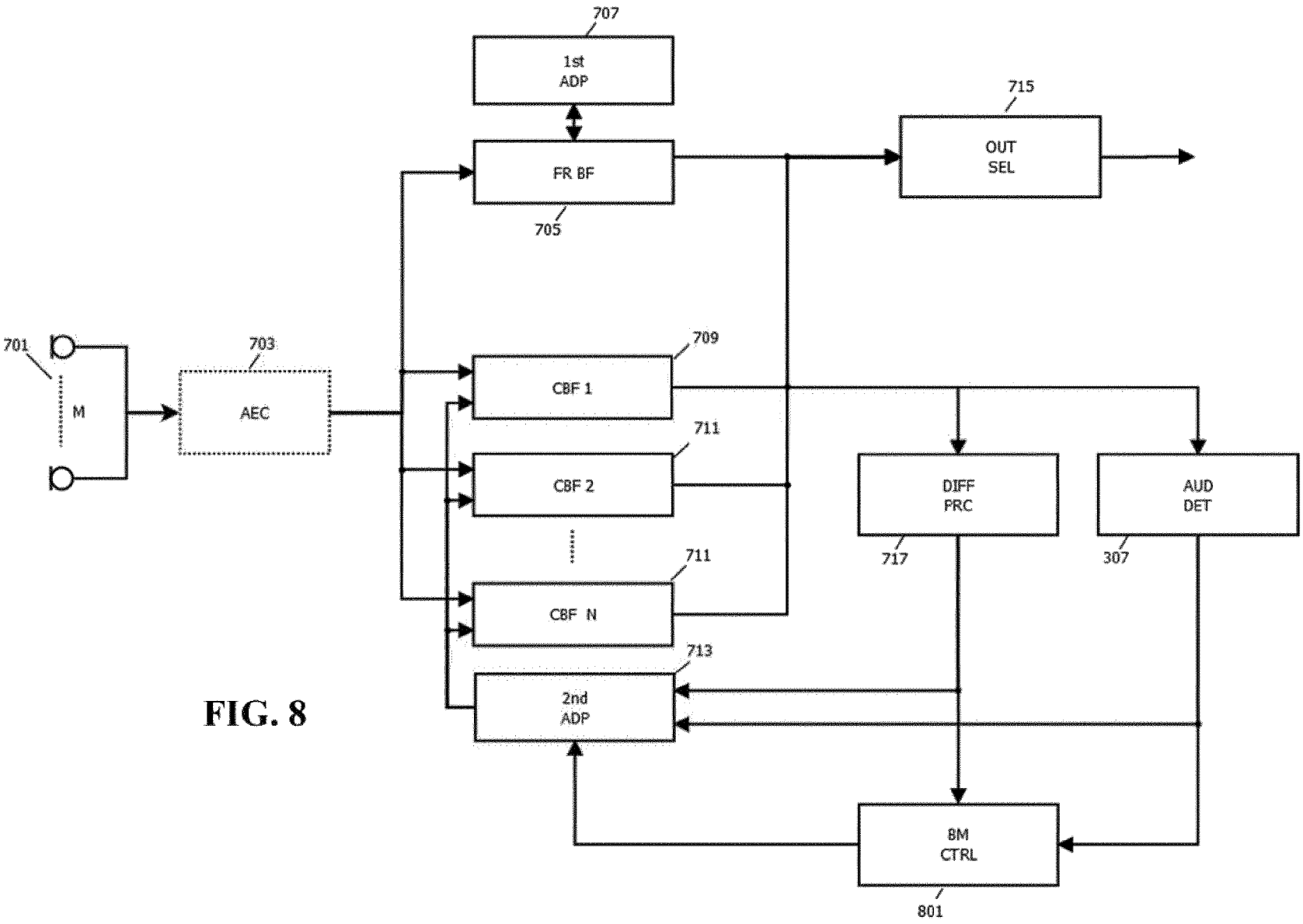
FIG. 8 illustrates an example of elements of an audio capturing apparatus in accordance with some embodiments of the invention.

FIG. 8 illustrates the audio capturing apparatus of FIG. 7 but with the addition of a beamformer controller 801 which is coupled to the second adapter 713 and the point audio source detector 307. The beamformer controller 801 is arranged to initialize a constrained beamformer 709, 711 in certain situations. Specifically, the beamformer controller 801 can initialize a constrained beamformer 709, 711 in response to the first beamformer 705, and specifically can initialize one of the constrained beamformers 709, 711 to form a beam corresponding to that of the first beamformer 705.

The beamformer controller 801 specifically sets the beamform parameters of one of the constrained beamformers 709, 711 in response to the beamform parameters of the first beamformer 705, henceforth referred to as the first beamform parameters. In some embodiments, the filters of the constrained beamformers 709, 711 and the first beamformer 705 may be identical, e.g. they may have the same architecture. As a specific example, both the filters of the constrained beamformers 709, 711 and the first beamformer 705 may be FIR filters with the same length (i.e. a given number of coefficients), and the current adapted coefficient values from filters of the first beamformer 705 may simply be copied to the constrained beamformer 709, 711, i.e. the coefficients of the constrained beamformer 709, 711 may be set to the values of the first beamformer 705. In this way, the constrained beamformer 709, 711 will be initialized with the same beam properties as currently adapted to by the first beamformer 705.

In some embodiments, the setting of the filters of the constrained beamformer 709, 711 may be determined from the filter parameters of the first beamformer 705 but rather than use these directly they may be adapted before being applied. For example, in some embodiments, the coefficients of FIR filters may be modified to initialize the beam of the constrained beamformer 709, 711 to be broader than the beam of the first beamformer 705 (but e.g. being formed in the same direction).

The beamformer controller 801 may in many embodiments accordingly in some circumstances initialize one of the constrained beamformers 709, 711 with an initial beam corresponding to that of the first beamformer 705. The system may then proceed to treat the constrained beamformer 709, 711 as previously described, and specifically may proceed to adapt the constrained beamformer 709, 711 when it meets the previously described criteria.

The criteria for initializing a constrained beamformer 709, 711 may be different in different embodiments.

In many embodiments, the beamformer controller 801 may be arranged to initialize a constrained beamformer 709, 711 if the presence of a point audio source is detected in the first beamformed audio output but not in any constrained beamformed audio outputs.

Thus, the point audio source detector 307 may determine whether a point audio source is present in any of the beamformed audio outputs from either the constrained beamformers 709, 711 or the first beamformer 705. The detection/estimation results for each beamformed audio output may be forwarded to the beamformer controller 801 which may evaluate this. If a point audio source is only detected for the first beamformer 705, but not for any of the constrained beamformers 709, 711, this may reflect a situation wherein a point audio source, such as a speaker, is present and detected by the first beamformer 705, but none of the constrained beamformers 709, 711 have detected or been adapted to the point audio source. In this case, the constrained beamformers 709, 711 may never (or only very slowly) adapt to the point audio source. Therefore, one of the constrained beamformers 709, 711 is initialized to form a beam corresponding to the point audio source. Subsequently, this beam is likely to be sufficiently close to the point audio source and it will (typically slowly but reliably) adapt to this new point audio source.

Thus, the approach may combine and provide advantageous effects of both the fast first beamformer 705 and of the reliable constrained beamformers 709, 711.

In some embodiments, the beamformer controller 801 may be arranged to initialize the constrained beamformer 709, 711 only if the difference measure for the constrained beamformer 709, 711 exceeds the threshold. Specifically, if the lowest determined difference measure for the constrained beamformers 709, 711 is below the threshold, no initialization is performed. In such a situation, it may be possible that the adaptation of constrained beamformer 709, 711 is closer to the desired situation whereas the less reliable adaptation of the first beamformer 705 is less accurate and may adapt to be closer to the first beamformer 705. Thus, in such scenarios where the difference measure is sufficiently low, it may be advantageous to allow the system to try to adapt automatically.

In some embodiments, the beamformer controller 801 may specifically be arranged to initialize a constrained beamformer 709, 711 when a point audio source is detected for both the first beamformer 705 and for one of the constrained beamformers 709, 711 but the difference measure for these fails to meet a similarity criterion. Specifically, the beamformer controller 801 may be arranged to set beamform parameters for a first constrained beamformer 709, 711 in response to the beamform parameters of the first beamformer 705 if a point audio source is detected both in the beamformed audio output from the first beamformer 705 and in the beamformed audio output from the constrained beamformer 709, 711, and the difference measure these exceeds a threshold.

Such a scenario may reflect a situation wherein the constrained beamformer 709, 711 may possibly have adapted to and captured a point audio source which however is different from the point audio source captured by the first beamformer 705. Thus, it may specifically reflect that a constrained beamformer 709, 711 may have captured the "wrong" point audio source. Accordingly, the constrained beamformer 709, 711 may be re-initialized to form a beam towards the desired point audio source.

In some embodiments, the number of constrained beamformers 709, 711 that are active may be varied. For example, the audio capturing apparatus may comprise functionality for forming a potentially relatively high number of constrained beamformers 709, 711. For example, it may implement up to, say, eight simultaneous constrained beamformers 709, 711. However, in order to reduce e.g. power consumption and computational load, not all of these may be active at the same time.

Thus, in some embodiments, an active set of constrained beamformers 709, 711 is selected from a larger pool of beamformers. This may specifically be done when a constrained beamformer 709, 711 is initialized. Thus, in the examples provided above, the initialization of a constrained beamformer 709, 711 (e.g. if no point audio source is detected in any active constrained beamformer 709, 711) may be achieved by initializing a non-active constrained beamformer 709, 711 from the pool thereby increasing the number of active constrained beamformers 709, 711.

If all constrained beamformers 709, 711 in the pool are currently active, the initialization of a constrained beamformer 709, 711 may be done by initializing a currently active constrained beamformer 709, 711. The constrained beamformer 709, 711 to be initialized may be selected in accordance with any suitable criterion. For example, the constrained beamformers 709, 711 having the largest difference measure or the lowest signal level may be selected.

In some embodiments, a constrained beamformer 709, 711 may be de-activated in response to a suitable criterion being met. For example, constrained beamformers 709, 711 may be de-activated if the difference measure increases above a given threshold.

A specific approach for controlling the adaptation and setting of the constrained beamformers 709, 711 in accordance with many of the examples described above is illustrated by the flowchart of FIG. 9.

The method starts in step 901 by the initializing the next processing time interval (e.g. waiting for the start of the next processing time interval, collecting a set of samples for the processing time interval, etc).

Step 901 is followed by step 903 wherein it is determined whether there is a point audio source detected in any of the beams of the constrained beamformers 709, 711.

If so, the method continues in step 905 wherein it is determined whether the difference measure meets a similarity criterion, and specifically whether the difference measure is below a threshold.

If so, the method continues in step 907 wherein the constrained beamformer 709, 711 in which the point audio source was detected (or which has the largest signal level in case a point audio source was detected in more than one constrained beamformer 709, 711) is adapted, i.e. the beamform (filter) parameters are updated.

If not, the method continues in step 909 wherein a constrained beamformer 709, 711 is initialized, the beamform parameters of a constrained beamformer 709, 711 is set dependent on the beamform parameters of the first beamformer 705. The constrained beamformer 709, 711 being initialized may be a new constrained beamformer 709, 711 (i.e. a beamformer from the pool of inactive beamformers) or may be an already active constrained beamformer 709, 711 for which new beamform parameters are provided.

Following either of steps 907 and 909, the method returns to step 901 and waits for the next processing time interval.

If it in step 903 is detected that no point audio source is detected in the beamformed audio output of any of the constrained beamformers 709, 711, the method proceeds to step 911 in which it is determined whether a point audio source is detected in the first beamformer 705, i.e. whether the current scenario corresponds to a point audio source being captured by the first beamformer 705 but by none of the constrained beamformers 709, 711.

If not, no point audio source has been detected at all and the method returns to step 901 to await the next processing time interval.

Otherwise, the method proceeds to step 913 wherein it is determined whether the difference measure meets a similarity criterion, and specifically whether the difference measure is below a threshold (which may be the same or may be a different threshold/criterion to that used in step 905).

If so, the method proceeds to step 915 wherein the constrained beamformer 709, 711 for which the difference measure is below the threshold is adapted (or if more than one constrained beamformer 709, 711 meets the criterion, the one with e.g. the lowest difference measure may be selected).

Otherwise, the method proceeds to step 917 wherein a constrained beamformer 709, 711 is initialized, the beamform parameters of a constrained beamformer 709, 711 is set dependent on the beamform parameters of the first beamformer 705. The constrained beamformer 709, 711 being initialized may be a new constrained beamformer 709, 711 (i.e. a beamformer from the pool of inactive beamformers) or may be an already active constrained beamformer 709, 711 for which new beamform parameters are provided.

Following either of steps 915 and 917, the method returns to step 901 and waits for the next processing time interval.

Figure 9:
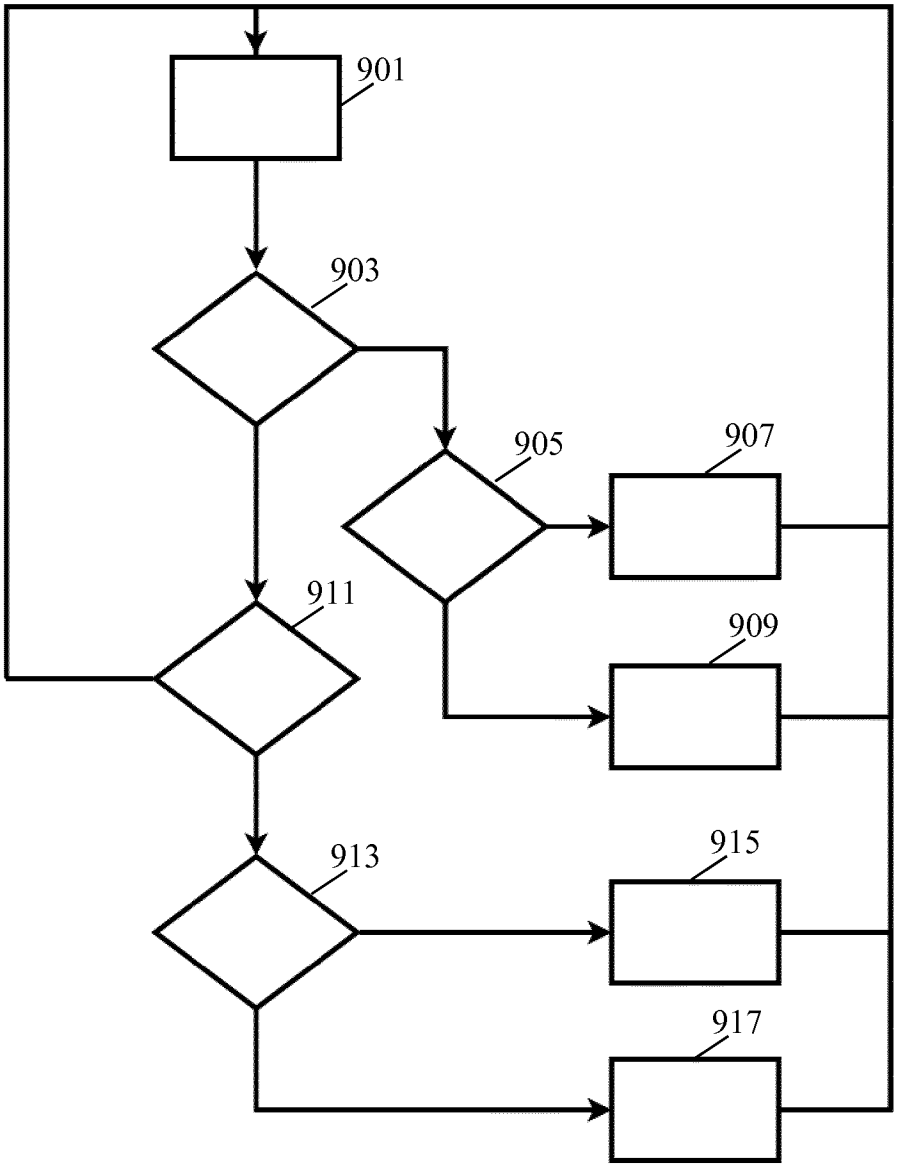
FIG. 9 illustrates an example of a flowchart for an approach of adapting constrained beamformers of an audio capturing apparatus in accordance with some embodiments of the invention.

The described approach of the audio capturing apparatus of FIG. 7-9 may provide advantageous performance in many scenarios and in particular may tend to allow the audio capturing apparatus to dynamically form focused, robust, and accurate beams to capture audio sources. The beams will tend to be adapted to cover different regions and the approach may e.g. automatically select and adapt the nearest constrained beamformer 709, 711.

Figure 2:
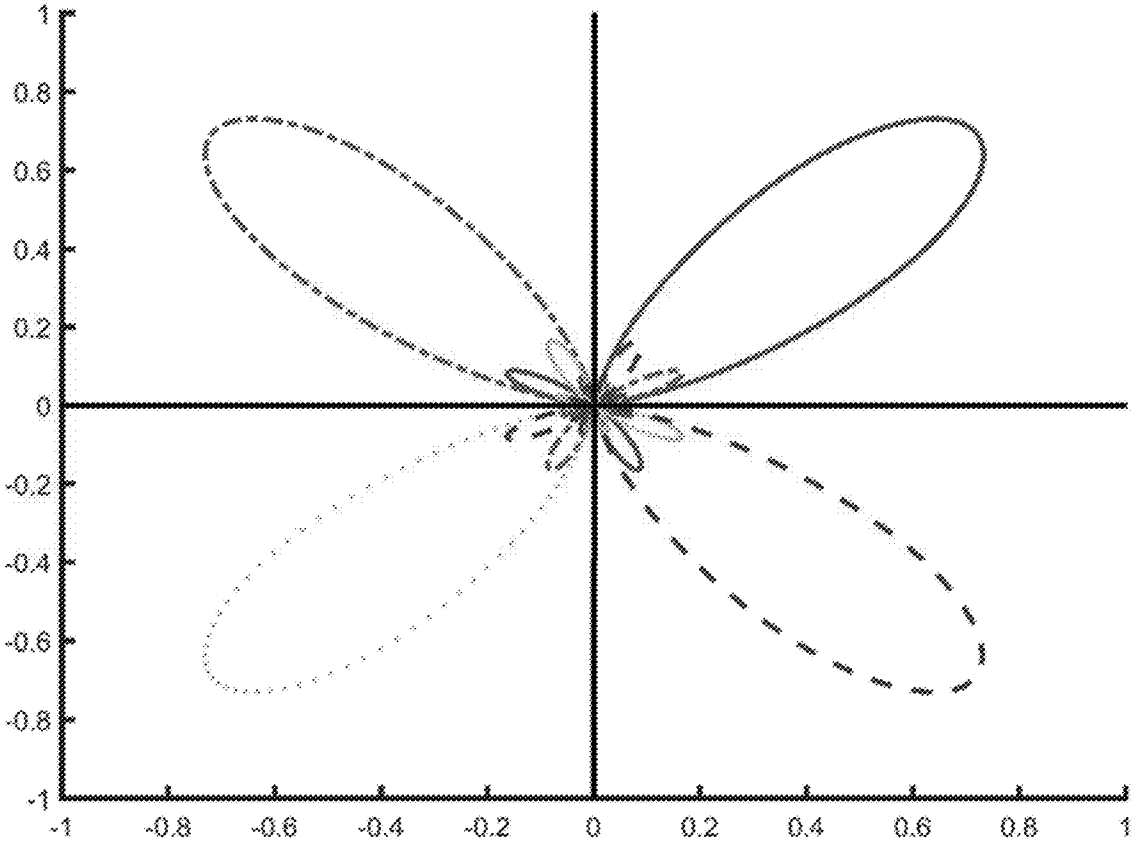
FIG. 2 PRIOR ART
FIG. 2 illustrates an example of a plurality of beams formed by an audio capturing system.

Thus, in contrast to the approach of e.g. FIG. 2, no specific constraints on the beam directions or on the filter coefficients need to be directly imposed. Rather, separate regions can automatically be generated/formed by letting the constrained beamformers 709, 711 only adapt (conditionally) when there is a single audio source dominant and when it is sufficiently close to the beam of the constrained beamformer 709, 711. This can specifically be determined by considering the filter coefficients which take into account both the direct field and the (first) reflections.

It should be noted that using filters with an extended impulse response (as opposed to using simple delay filters, i.e. single coefficient filters) also takes into account that reflections arrive some (specific) time after the direct field. Accordingly, a beam is not only determined by spatial characteristics (from which directions the direct field and reflections arrive from) but is also determined by temporal characteristics, (at which times after the direct field do reflections arrive). Thus, references to beams are not merely restricted to spatial considerations but also reflect the temporal component of the beamform filters. Similarly, the references to regions include both the purely spatial as well as the temporal effects of the beamform filters.

The approach can thus be considered to form regions that are determined by the difference in the distance measure between the free running beam of the first beamformer 705 and the beam of the constrained beamformer 709, 711. For example, suppose a constrained beamformer 709, 711 has a beam focused on a source (with both spatial and temporal characteristics). Suppose the source is silent and a new source becomes active with the first beamformer 705 adapting to focus on this. Then every source with spatio-temporal characteristics such that the distance between the beam of the first beamformer 705 and the beam of the constrained beamformer 709, 711 does not exceed a threshold can be considered to be in the region of the constrained beamformer 709, 711. In this way, the constraint on the first constrained beamformer 709 can be considered to translate into a constraint in space.

The distance criterion for adaptation of a constrained beamformer together with the approach of initializing beams (e.g. copying of beamform filter coefficients) typically provides for the constrained beamformers 709, 711 to form beams in different regions.

The approach typically results in the automatic formation of regions reflecting the presence of audio sources in the environment rather than a predetermined fixed system as that of FIG. 2. This flexible approach allows the system to be based on spatio-temporal characteristics, such as those caused by reflections, which would be very difficult and complex to include for a predetermined and fixed system (as these characteristics depend on many parameters such as the size, shape and reverberation characteristics of the room etc).

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An audio capture apparatus comprising a microphone array;

at least a first beamformer, wherein the at least first beamformer is arranged to generate a beamformed audio output signal and at least one noise reference signal;

a first transformer, wherein the first transformer is arranged to generate a first frequency domain signal from a frequency transform of the beamformed audio output signal, wherein the first frequency domain signal is represented by time frequency tile values;

a second transformer, wherein the second transformer is arranged generate a second frequency domain signal from a frequency transform of the at least one noise reference signal, and wherein the second frequency domain signal is represented by time frequency tile values;

a difference processor circuit, and wherein a processor circuit is arranged to generate time frequency tile difference measures, and wherein a time frequency tile difference measure for a first frequency is indicative of a difference between a first monotonic function of a norm of a time frequency tile value of the first frequency domain signal for the first frequency and a second monotonic function of a norm of a time frequency tile value of the second frequency domain signal for the first frequency;

a point audio source estimator, wherein the point audio source estimator is arranged to generate a point audio source estimate, wherein the point audio source estimate is indicative of whether the beamformed audio output signal comprises a point audio source, and wherein the point audio source estimator is arranged to generate the point audio source estimate in response to a combined difference value for time frequency tile difference measures for frequencies above a frequency threshold.

2. The audio capturing apparatus of claim 1, wherein the point audio source estimator is arranged to detect a presence of a point audio source in the beamformed audio output in response to the combined difference value exceeding a threshold.

3. The audio capturing apparatus of claim 1, wherein the frequency threshold is above 500 Hz.

4. The audio capture apparatus of claim 1, wherein the difference processor circuit is arranged to generate a noise coherence estimate, wherein the noise coherence estimate is indicative of a correlation between an amplitude of the beamformed audio output signal and an amplitude of the at least one noise reference signal, and wherein at least one of the first monotonic function and the second monotonic function is dependent on the noise coherence estimate.

5. The audio capturing apparatus of claim 1, wherein the difference processor circuit is arranged to scale the norm of the time frequency tile value of the first frequency domain signal for the first frequency relative to the norm of the time frequency tile value of the second frequency domain signal for the first frequency in response to the noise coherence estimate.

6. The audio capturing apparatus of claim 1, wherein the difference processor circuit is arranged to generate the time frequency tile difference measure for time $t_k$ at frequency $\omega_l$ substantially as:

$$d=|Z(t_k,\omega_l)|-\gamma C(t_k,\omega_l)|X(t_k,\omega_l)|$$

where $Z(t_k,\omega_l)$ is the time frequency tile value for the beamformed audio output signal at time $t_k$ at frequency $\omega_l$;

wherein $X(t_k,\omega_l)$ is the time frequency tile value for the at least one noise reference signal at time $t_k$ at frequency $\omega_l$;

wherein $C(t_k,\omega_l)$ is a noise coherence estimate at time $t_k$ at frequency $\omega_l$; and $\gamma$ is a design parameter, and wherein d is distance.

7. The audio capturing apparatus of claim 1, wherein the difference processor circuit is arranged to filter at least one of the time frequency tile values of the beamformed audio output signal and the time frequency tile values of the at least one noise reference signal.

8. The audio capturing apparatus of claim 6, wherein the filter is arranged in both a frequency domain and a time domain.

9. The audio capturing apparatus of claim 1, further comprising:

a plurality of beamformers wherein the plurality of beamformers include the beamformer; and an adapter circuit, wherein the point audio source estimator is arranged to generate a point audio source estimate for each beamformer of the plurality of beamformers, and wherein the adapter circuit is arranged to adapt at least one of the plurality of beamformers in response to the point audio source estimates.

10. The audio capturing apparatus of claim 9, further comprising a plurality of constrained beamformers, wherein the plurality of beamformers comprises a first beamformer, wherein the first beamformer is arranged to generate a beamformed audio output signal and at least one noise reference signal, wherein the plurality of constrained beamformers are coupled to the microphone array, wherein each of the plurality of constrained beamformers are arranged to generate a constrained beamformed audio output and at least one constrained noise reference signal wherein the audio capturing apparatus further comprises:

a beam difference processor circuit, wherein the beam difference processor circuit is arranged to determine a difference measure for at least one of the plurality of constrained beamformers, wherein the difference measure is indicative of a difference between beams formed by the first beamformer and the at least one of the plurality of constrained beamformers, and wherein the adapter circuit is arranged to adapt constrained beamform parameters with a constraint that constrained beamform parameters are adapted only for constrained beamformers of the plurality of constrained beamformers for which a difference measure has been determined that meets a similarity criterion.

11. The apparatus of claim 10, wherein the adapter circuit is arranged to adapt constrained beamform parameters only for constrained beamformers for which the point audio source estimate is indicative of a presence of a point audio source in the constrained beamformed audio output.

12. The apparatus of claim 10, wherein the adapter circuit is arranged to adapt constrained beamform parameters only for the constrained beamformer for which the point audio source estimate is indicative of highest probability that the beamformed audio output comprises a point audio source.

13. The apparatus of claim 10, wherein the adapter circuit is arranged to adapt constrained beamform parameters only for the constrained beamformer having a highest value of the point audio source estimate.

14. A method of operation for capturing audio, the method comprising:

generating a beamformed audio output signal and at least one noise reference signal using at least a first beamformer;

generating a first frequency domain signal from a frequency transform of the beamformed audio output signal using a first transformer, wherein the first frequency domain signal is represented by time frequency tile values;

generating a second frequency domain signal from a frequency transform of the at least one noise reference signal using a second transformer, wherein the second frequency domain signal is represented by time frequency tile values;

generating time frequency tile difference measures using a difference processor circuit, wherein a time frequency tile difference measure for a first frequency is indicative of a difference between a first monotonic function of a norm of a time frequency tile value of the first frequency domain signal for the first frequency and a second monotonic function of a norm of a time frequency tile value of the second frequency domain signal for the first frequency; and generating a point audio source estimate using a point audio source estimator, wherein the point audio source estimate is indicative of whether the beamformed audio output signal comprises a point audio source, and wherein the point audio source estimator is arranged to generate the point audio source estimate in response to a combined difference value for time frequency tile difference measures for frequencies above a frequency threshold.

15. A computer program product comprising computer program code stored in a non-transitory media, wherein the computer program code is arranged to perform the method of claim 14 when the computer program code is run on a computer.

16. The method of operation for capturing audio as claimed in claim 14, further comprising a microphone array.

17. The method of operation for capturing audio as claimed in claim 14, wherein the point audio source estimator is arranged to detect a presence of a point audio source in the beamformed audio output in response to the combined difference value exceeding a threshold.

18. The method of operation for capturing audio as claimed in claim 14, wherein the frequency threshold is above 500 Hz.

19. The method of operation for capturing audio as claimed in claim 14, wherein the difference processor circuit is arranged to generate a noise coherence estimate, wherein the noise coherence estimate is indicative of a correlation between an amplitude of the beamformed audio output signal and an amplitude of the at least one noise reference signal, and wherein at least one of the first monotonic function and the second monotonic function is dependent on the noise coherence estimate.

20. The method of operation for capturing audio as claimed in claim 14, wherein the difference processor circuit is arranged to scale the norm of the time frequency tile value of the first frequency domain signal for the first frequency relative to the norm of the time frequency tile value of the second frequency domain signal for the first frequency in response to the noise coherence estimate.

21. The method of operation for capturing audio as claimed in claim 14, wherein the difference processor circuit is arranged to generate the time frequency tile difference measure for time $t_k$ at frequency $\omega_l$ substantially as:

$$d=|Z(t_k,\omega_l)|-\gamma C(t_k,\omega_l)|X(t_k,\omega_l)|$$

where $Z(t_k,\omega_l)$ is the time frequency tile value for the beamformed audio output signal at time $t_k$ at frequency $\omega_l$;

wherein $X(t_k,\omega_l)$ is the time frequency tile value for the at least one noise reference signal at time $t_k$ at frequency $\omega_l$;

wherein $C(t_k,\omega_l)$ is a noise coherence estimate at time $t_k$ at frequency $\omega_l$; and $\gamma$ is a design parameter.

* * * * *